US009668585B2

(12) United States Patent
Garland

(10) Patent No.: US 9,668,585 B2
(45) Date of Patent: Jun. 6, 2017

(54) FOLDABLE ARTICULATED SOFA BED

(71) Applicant: American Leather Operations, LLC, Dallas, TX (US)

(72) Inventor: Thomas A. Garland, Bradenton, FL (US)

(73) Assignee: American Leather Operations, LLC, Dallas, TX (US)

( * ) Notice: Subject to any disclaimer, the term of this patent is extended or adjusted under 35 U.S.C. 154(b) by 281 days.

(21) Appl. No.: 14/496,005

(22) Filed: Sep. 25, 2014

(65) Prior Publication Data

US 2015/0007385 A1 Jan. 8, 2015

Related U.S. Application Data

(63) Continuation of application No. 13/653,945, filed on Oct. 17, 2012, now Pat. No. 8,893,323.

(60) Provisional application No. 61/549,713, filed on Oct. 20, 2011.

(51) Int. Cl.

| | |
|---|---|
| ***A47C 17/04*** | (2006.01) |
| ***A47C 17/213*** | (2006.01) |
| ***A47C 17/207*** | (2006.01) |
| ***A47C 17/17*** | (2006.01) |

(52) U.S. Cl.

CPC ..... *A47C 17/213* (2013.01); *A47C 17/17* (2013.01); *A47C 17/2076* (2013.01)

(58) Field of Classification Search

CPC ..... A47C 17/04
USPC ..... 5/12.1, 13, 14, 28–32, 37.1, 36, 42
See application file for complete search history.

(56) References Cited

U.S. PATENT DOCUMENTS

| | | | |
|---|---|---|---|
| 2,007,988 | A | 7/1935 | Thomas, Jr. |
| 2,570,401 | A | 10/1951 | Stein |
| 2,664,145 | A | 12/1953 | Creveling et al. |
| 2,671,228 | A | 3/1954 | De Maria |
| 2,740,131 | A | 4/1956 | Vogel et al. |
| 2,785,415 | A | 3/1957 | Peterson |
| 2,876,461 | A | 3/1959 | Bontempi |
| 3,085,257 | A | 4/1963 | Laemmle |
| 3,104,913 | A | 9/1963 | Faulkner et al. |
| 3,145,049 | A | 8/1964 | Duke |

(Continued)

FOREIGN PATENT DOCUMENTS

| | | |
|---|---|---|
| CA | 953053 | 8/1974 |
| CN | 2043842 | 9/1989 |

(Continued)

OTHER PUBLICATIONS

Cover of HighPoints publication, Tiffany Sleeper, Market Introductions, Apr. 2000, 1 pg.

(Continued)

*Primary Examiner* — Fredrick Conley
(74) *Attorney, Agent, or Firm* — Womble Carlyle Sandridge & Rice, LLP

(57) ABSTRACT

A convertible furniture piece has a compact profile while folded with the seat cushions residing at a comfortable and ergonomic height and an esthetically pleasing streamlined appearance. The convertible furniture takes advantage of a leg assembly that is anchored within the thickness of the mechanism panels so as to stack the foot and body panels closer to each other. The leg assembly is also anchored at a position other than the edges of the panels to help conceal the leg assembly below the bed.

19 Claims, 19 Drawing Sheets

(56) References Cited

U.S. PATENT DOCUMENTS

| | | | | |
|---|---|---|---|---|
| 3,178,731 | A | 4/1965 | Pokorny, Jr. | |
| 3,179,469 | A | 4/1965 | Heuston | |
| 3,319,269 | A | 5/1967 | Maddox | |
| 3,456,268 | A | 7/1969 | Rogers, Jr. | |
| 3,506,984 | A | 4/1970 | Ellis, Jr. et al. | |
| 3,508,283 | A | 4/1970 | Dukellis et al. | |
| 3,589,770 | A | 6/1971 | Kelley | |
| 3,608,959 | A | 9/1971 | Sarvas | |
| 3,695,690 | A | 10/1972 | Carson | |
| 3,771,178 | A | 11/1973 | Inman | |
| 3,844,612 | A | 10/1974 | Borggren et al. | |
| 3,864,764 | A | 2/1975 | Janusc | |
| 3,908,210 | A | 9/1975 | Alembik | |
| 4,032,999 | A | 7/1977 | Pringle | |
| 4,563,037 | A | 1/1986 | Tiffany | |
| 4,694,514 | A | 9/1987 | Crossett | |
| 4,737,996 | A | 4/1988 | Tiffany | |
| D338,349 | S | 8/1993 | Warnock | |
| 5,320,407 | A | 6/1994 | Tell | |
| D360,311 | S | 7/1995 | Stamberg et al. | |
| D367,566 | S | 3/1996 | Walters, III et al. | |
| 5,626,388 | A | 5/1997 | Haltner | |
| 5,681,090 | A | 10/1997 | St. Thomas | |
| 5,826,939 | A | 10/1998 | Beyer | |
| 5,855,030 | A | 1/1999 | Williams | |
| 5,904,401 | A | 5/1999 | Alberda et al. | |
| 6,089,657 | A | 7/2000 | Banno et al. | |
| 6,116,685 | A | 9/2000 | White et al. | |
| 6,293,624 | B1 | 9/2001 | Gaylord et al. | |
| 6,709,054 | B2 | 3/2004 | Riley et al. | |
| 6,796,609 | B2 | 9/2004 | Illulian | |
| D501,331 | S | 2/2005 | Chen | |
| 6,904,628 | B2 | 6/2005 | Murphy et al. | |
| 7,040,700 | B2 | 5/2006 | Duncan et al. | |
| D526,803 | S | 8/2006 | Lee | |
| 7,373,675 | B2 | 5/2008 | Thurow | |
| 7,549,182 | B2 | 6/2009 | Murphy | |
| 8,011,034 | B2 | 9/2011 | Hoffman et al. | |
| 8,997,273 | B2 | 4/2015 | Murphy et al. | |
| 2003/0070225 | A1* | 4/2003 | Murphy ..... | A47C 17/1753 5/13 |
| 2007/0283491 | A1 | 12/2007 | Murphy | |
| 2009/0235452 | A1 | 9/2009 | Hoffman et al. | |
| 2011/0010846 | A1 | 1/2011 | Murphy | |
| 2011/0010847 | A1 | 1/2011 | Murphy | |
| 2011/0018331 | A1 | 1/2011 | Murphy et al. | |

FOREIGN PATENT DOCUMENTS

| | | |
|---|---|---|
| CN | 2060312 | 8/1990 |
| CN | 2222467 | 3/1996 |
| CN | 1271554 | 11/2000 |
| DE | 3513076 | 10/1986 |
| EP | 645108 | 3/1995 |
| GB | 2150021 | 6/1985 |
| JP | 5091464 | 9/1974 |
| WO | 9015556 | 12/1990 |
| WO | 2013059309 | 4/2013 |

OTHER PUBLICATIONS

Cover of The Philadelphia Inquirer, Home and Design Section, Apr. 21, 2000, 1 pg.
Functional Upholstery Takes Center Stage, Furniture Today, vol. 24, No. 30d, Apr. 9, 2000, 2 pgs.
Home & Garden, Sun-Sentinel, p. 3E, South Florida, Apr. 14, 2000, 1 pg.
International Search Report and Written Opinion for PCT/US2013/64581, dated Mar. 25, 2014, 22 pgs.
Photograph 1, Version 1, sofa shown at trade show in San Francisco, folding center leg and Version 1 front leg actuator, Jan. 2000, 1 pg.
Photograph 10, Versions 1 and 2, inside arm sprint assist, Jan. 2000, 1 pg.
Photograph 11, Versions 1 and 2, inside arm spring assist, Jan. 2000, 1 pg.
Photograph 12, Versions 1 and 2, inside arm spring assist, Jan. 2000, 1 pg.
Photograph 2, Version 1, sofa shown at trade show in San Francisco, sofa partially opened, Jan. 2000, 1 pg.
Photograph 3, Version 1, sofa shown at trade show in San Francisco, sofa completely opened, Jan. 2000, 1 pg.
Photograph 4, Version 1, sofa shown at trade show in San Francisco, tube assembly front pivot offset and extended and folding center leg extended, Jan. 2000, 1 pg.
Photograph 5, Version 1, sofa shown at trade show in San Francisco, folding center leg extended and front wood leg with Version 1 of front leg actuator, Jan. 2000, 1 pg.
Photograph 6, Version 2, sofa shown at trade show in High Point, folding center leg extended and metal tube front leg with Version 2 of front leg actuator, Apr. 2000, 1 pg.
Photograph 7, Version 2, sofa shown at trade show in High Point, metal tube front leg with Version 2 of front leg actuator and folding center leg extended, Apr. 2000, 1 pg.
Photograph 8, Version 2, sofa shown at trade show in High Point, metal tube front leg with Version 2 of front leg actuator and folding center leg extended, Apr. 2000, 1 pg.
Photograph 9, Versions 1 and 2, tube assembly front pivot (offset & extended), Jan. 2000, 1 pg.
UDM Design News, p. 32, Jun. 2000, 1 pg.
English abstract of CN1271554, last viewed on Espacenet.com on Oct. 30, 2015, 1 pg.
English abstract of CN2043842, last viewed on Espacenet.com on Oct. 30, 2015, 1 pg.
English abstract of CN2222467, last viewed on Espacenet.com on Oct. 30, 2015, 1 pg.
English abstract of CN2060312, last viewed on Espacenet.com on Oct. 30, 2015, 1 pg.
Abstract of corresponding U.S. Pat. No. 3,868,733, to JPS5091464, last viewed on Espacenet.com on Oct. 30, 2015, 1 pg.

* cited by examiner

FOLDABLE ARTICULATED SOFA BED

CROSS REFERENCE TO RELATED APPLICATION

This application is a continuation of U.S. application Ser. No. 13/653,945 filed Oct. 17, 2012, which claims the benefit of Provisional Application Ser. No. 61/549,713 filed on Oct. 20, 2011. The content of these applications is incorporated herein by reference in their entirety.

TECHNICAL FIELD

The present invention relates to furniture, and more particularly to a foldable articulated sofa bed.

BACKGROUND ART

The prior art includes a range of designs of a sofa that can be converted into a bed. One such design is shown in U.S. Pat. No. 2,740,131. In this patent, a mechanism, in an unfolded position, has three sections, therein called respectively a "back section", an "intermediate section", and a "forward seating section", and each section includes an integrally formed mattress portion having a surface defining a face of the section. Collectively the three sections form the bed. When the mechanism is in a folded position, the back section becomes the back portion of the sofa, the forward seating section becomes the seat support portion of the sofa, and the intermediate section is stowed in a generally horizontal position, beneath the forward seating support portion, and faces the floor. The stowed configuration is shown in FIG. 2 of the '131 patent.

U.S. Pat. No. 8,011,034 discloses an improvement over the design of U.S. Pat. No. 2,740,131. In U.S. Pat. No. 8,011,034, there are provided, as part of the mechanism, a head panel, a middle panel, and a foot panel (therein called respectively a "backrest panel", a "subseat panel", and a "seat panel") and each panel has an attached mattress section (therein termed a "cushion"). The same general geometry applies as in the U.S. Pat. No. 2,740,131, except that, as suggested by FIG. 4 of U.S. Pat. No. 8,011,034, the improved design typically requires, when the mechanism is in the folded position, the addition of a removable seat and back cushions. In at least some embodiments, the geometry of the mechanism is such that the sofa frame must be specially designed to accommodate the mechanism, and the seat cushion must similarly be specially designed to satisfactorily overlie the seat panel, leading to a very bulky sofa frame.

SUMMARY OF THE EMBODIMENTS

There is now described a convertible sofa bed that occupies a small footprint back to front, and with foot and middle sections of the bed, which form the seat support of the sofa when folded, that occupy a thin vertical space. The footprint is reduced from conventional previously known sofa bed of the same type by a novel design of the 4-bar assemblies that move the head panel of the bed into the folded configuration. With the novel 4-bar assembly, only a small section of the rear swinging member of the 4-bar assemblies, which rotate the head panel, is located behind the head panel when the head panel is retracted into the back of the sofa when the bed is in a folded configuration. Also, a portion of the forward swinging member of the 4-bar assemblies is positioned below and forward of the hinge point that connects the foot and middle panels of the bed. The back panel of the sofa can thus be brought closer to the front of the sofa, thus reducing the footprint, and giving the sofa bed an appearance of a contemporary sofa. The vertical space of the foot and middle panels also is reduced in part by a design of the leg assemblies which positions the anchor points of the movable members of the leg assemblies within the thickness of the panels. The vertical space is further reduced by using thinner panel boards, such as three quarter inch boards instead of one and a quarter inch boards.

Embodiments of the invention may be used in sofa beds of the type having a frame with opposed arms and, located between the arms, a bed assembly. The bed assembly includes a head panel, a middle panel, and a foot panel of a bed, with each panel preferably having a face for receiving a mattress. The middle and foot panels are pivotally connected at a hinge point positioned toward the rear of the sofa. The bed assembly also includes a pair of rear head panel 4-bar assemblies, each to the right and left of the bed, and a pair of middle panel assemblies, each to the right and left of the bed and connected to the arms of the sofa. The right and left head panel assemblies are optionally connected to each other by cross members. The bed assembly further includes middle and foot panel legs operated by a pair of leg assemblies, each to the right and left of the bed. These right and left leg assemblies are also optionally connected to each other by cross members. When the bed is in a folded position, the head panel is oriented in a generally vertical position in the back of the sofa and its mattress faces forward, the middle panel is oriented in a generally horizontal position and its mattress faces the floor, and the foot panel is stacked above the middle panel in a generally horizontal orientation and its mattress faces upward. The middle and foot panels form a seat support. Removable seat and back cushions are disposed on the folded bed on top of the seat support to form a sofa. Each of the arms has a rearmost mounting point for pivotally attaching a rear swinging member and having a mid mounting point for pivotally attaching a forward swinging member of the head panel 4-bar assembly. Each of the rear and forward swinging members is pivotally attached to the head panel with the rear swinging member being attached to the head panel at a pivot point of the head panel higher than the pivot point of the forward swinging member in the folded position.

In one embodiment of the invention, the rear swinging members are the sofa bed's only pivotally mounted linking member occupying space behind the head panel in the folded position along a section of the rear swinging members' length. In another embodiment, the rear swinging members are pivotally connected to only the rearmost mounting points of the head panel, and not to any other of the sofa bed's pivotally mounted linking members. In other embodiments, the rear swinging members may have both of these characteristics.

In another embodiment, the head panel is disposed with respect to the rearmost mounting points such that a portion of the head panel extends more rearwardly than the rearmost mounting points for most of the transit as the middle panel moves from a horizontal orientation in the folded position to a vertical orientation as the bed assembly moves to the unfolded position. In a further embodiment, the head panel is disposed with respect to the rearmost mounting points of the rear swing members such that a portion of the head panel extends more rearwardly than the rearmost mounting points for most of the transit as the bed assembly moves from the folded position to the unfolded position. In yet another embodiment, a sofa bed having such an orientation of the head panel and the rearmost mounting points may also include rear swinging members having either or both of the characteristics discussed above.

In other embodiments, the forward swinging member is pivotally connected to the mid mounting point and disposed below and forward of the hinge point when the assembly is in the folded position. In other embodiments, the rear swinging member's rearmost mounting point is located below and about the vertical of the pivot point of the forward swinging member with the head panel.

In some embodiments, the head and middle panels are connected by a connecting arm, wherein the connecting arm is pivotally attached to the head panel at a connecting-arm point, and the rearmost mounting point is disposed below and forward of the connecting-arm point when the assembly is in the folded position. In other embodiments, the sofa further includes middle and foot panels which are connected at a hinge point, wherein the mid mounting point is disposed below and forward of the hinge point when the assembly is in the folded position. In other embodiments, the sofa further includes the head panel that is disposed with respect to the rearmost mounting point such that a portion of the head panel extends more rearwardly than the rearmost mounting point for most of the transit as the assembly moves from the folded position to the unfolded position. In other embodiments, the sofa includes one or more of the characteristics discussed above.

Embodiments of the invention may also be used in sofa beds having a pair of retractable middle legs that support the middle panel when in the unfolded position and a pair of retractable foot legs that support the foot panel when in the unfolded position. In one embodiment of the invention, the middle legs are pivotally connected to the middle panel at middle mounting points located within the thickness of the middle panel, and the foot legs being pivotally connected to the foot panel at foot mounting points located within the thickness of the foot panel. In another embodiment, the two foot legs are spaced further apart from each other than the two middle legs. In other embodiments, the retractable legs may have both of these characteristics. In yet another embodiment, a sofa bed having retractable legs with either or both of these characteristics may also include rear swinging members having either or both of the characteristics discussed above. In yet a further embodiment, a sofa bed having retractable legs with either or both of these characteristics may also include a sofa bed having such an orientation of the head panel and the rearmost mounting point as discussed above.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Definitions

As used in this description and the accompanying claims, the following terms shall have the meanings indicated, unless the context otherwise requires:

Where used, the terms "secured," "attached," "connected," "interconnected," "contacting," "mounted," "coupled," "linked," and the like can mean either direct or indirect attachment or contact between elements, unless stated otherwise. Also, spatial terms, such as "under," "below," "lower," "over," "upper," "above," "top," "bottom," "proximal," "distal," "upward," "downward," "backward," "forward," and the like, are used herein for ease of description to describe one element or feature's relationship to another element(s) or feature(s) as illustrated in the figures and are relative to one another. It should be understood that the spatially relative terms are intended to encompass a variety of different spatial orientations of the article as may be placed during use, operation, or transport of the article, in addition to the specific spatial orientation depicted in the figures. For example, if the article in the figures is inverted 180° within the plane, elements described as "under" or "beneath" other elements or features would then be oriented "over" the other elements or features. The article may be otherwise oriented (rotated 90 degrees or at other orientations) and the descriptors of relative spatial orientations used herein should be interpreted accordingly. The same is true of the terms "backward" and "forward" as the bed is being manipulated from an open to close configuration and vice versa.

Figure 1:
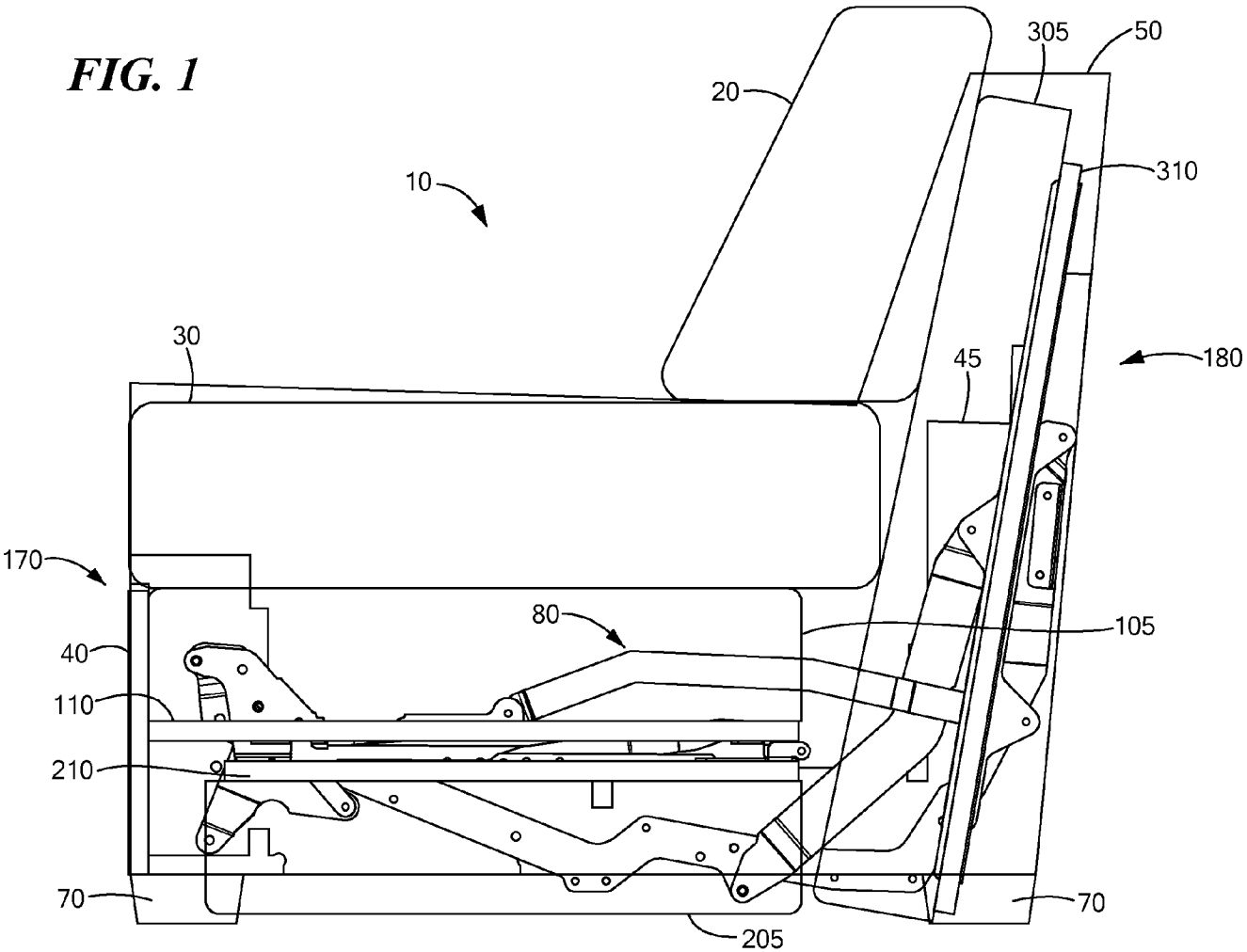
FIG. 1 is a depiction of a lateral view of an embodiment of the sofa bed with the bed assembly folded within the sofa.

FIG. 1 is a lateral depiction of an embodiment of the sofa bed 10 according to the invention having back cushions 20, seat cushions 30, an outer arm panel 50, an inner arm panel 45 and sofa feet 70. One of the bed deployment assemblies 80 is depicted in a fully folded position, with the foot panel frame 110 and its foot panel mattress 105 facing the seat cushion 30 folded over the middle panel frame 210 with its middle panel mattress 205 facing the floor. The horizontal foot panel frame 110 abuts the vertical foot end bed frame 40 at the front end 170 of the sofa bed 10. The head panel frame 310 with its head panel mattress 305 is in a substantially upright position, with a noticeable angle θ1 (see FIGS. 7A-E for a depiction of the angles discussed) from the vertical within the back 180 of the sofa bed 10. The rear of the outer arm panel 50 is also at a noticeable angle θ2 from the vertical such that its lower end is shifted toward the front end 170 of the sofa bed 10. The middle panel frame 210 is movably secured to the deployment assembly support member (item 240 in FIG. 3) at its proximal end toward the front end 170 of the sofa bed 10. For ease of illustration, only one of the deployment assemblies is described, but the sofa bed 10 includes one deployment assembly on each side of the bed frame, the right and left side. The deployment assembly support member 240 is rigidly secured to inner arm panel 45 mounted on the inner side of the outer arm panel 50. The head panel frame 310 is movably secured to the deployment assembly support member 240 at its distal end toward the back end 180 of the sofa bed 10.

Figure 2:
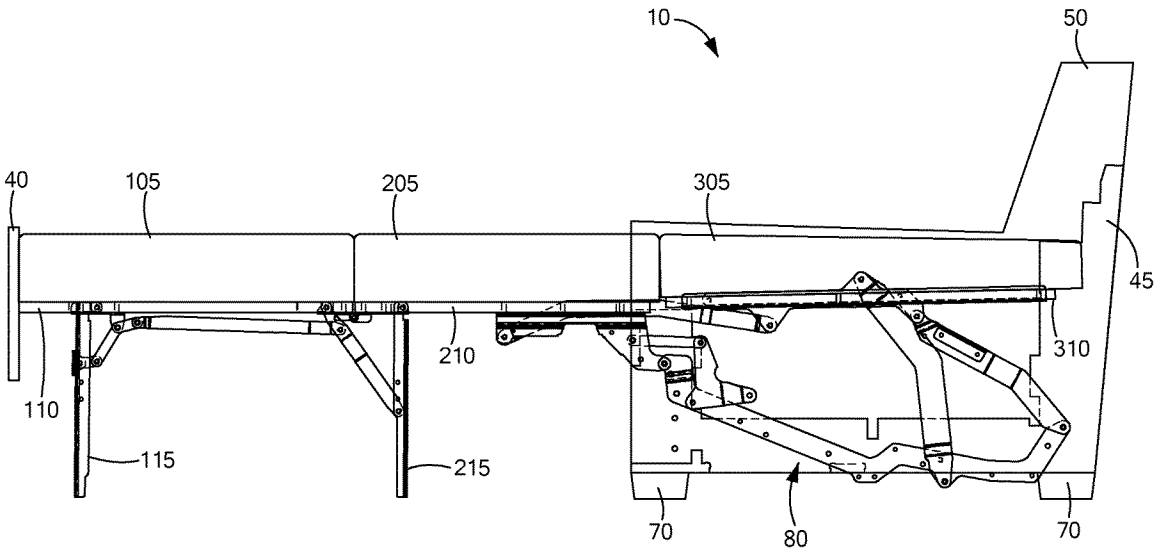
FIG. 2 is a depiction of a lateral view of an embodiment of the sofa bed with the bed assembly unfolded out of the sofa.

FIG. 2 is a lateral depiction of an embodiment of the sofa bed 10 according to the invention with the bed in a fully deployed position. The foot panel frame 110 is supported by foot panel legs 115 while the middle panel from 210 is supported by middle panel legs 215.

FIGS. 3 and 4A-E are lateral depictions of an embodiment of the sofa bed 10 according to the invention showing one of the bed deployment assemblies 80 at rest and at various stages of motion. The middle panel frame 210 is movably secured to the deployment assembly support member 240 at its proximal end toward the front end 170 of the sofa bed 10 by a distal end of middle panel anchor plate 220. The distal end of middle panel anchor plate 220 is also movably connected at to the proximal end of a middle panel connector 225. The distal end of the middle panel connector 225 is movably connected to one of the protrusions of rotating plate 235. Another protrusion of rotating plate 235 is movably connected to the proximal end of bed deployment assembly support member 240. The bed deployment assembly support member 240 is fixedly secured to the inner arm panel 45. The distal end of middle panel anchor plate 220 is rotated around at its anchor point (pivot point 907 shown in FIG. 5) with the deployment assembly support member 240, by the torque applied by both the middle panel connector 225 and rotating plate 235 (better visualized in FIG. 4C) deploying or retracting middle panel 200.

The head panel frame 310 is movably secured to the bed deployment assembly support member 240 by both the head panel forward swinging member 315 and the head panel rear swinging member 320. The forward/top sections of both forward and rear swinging members 315 and 320 are movably connected to the head panel frame 310 at opposite forward/top and rear/bottom sides of the head panel frame 310, respectively, by an anchor plate 330 positioned about the mid-section of the head panel frame 310. The forward swinging member 315 is movably connected to a middle section 330*b* of anchor plate 330 (better visualized in FIG. 4C) which protrudes on the forward-facing/top side of the head panel frame 310. The rear swinging member 320 is movably connected to a distal section 330*a* of anchor plate 330 (better visualized in FIG. 4C) which protrudes on the backward-facing/bottom side of the head panel frame 310. Also, middle panel frame 210 is movably connected to head panel frame 310 by a middle-to-head connecting arm 230. The forward end of the middle-to-head connecting arm 230 is movably connected to middle panel frame 210 at the proximal end of middle panel anchor plate 220. The distal end of the middle-to-head connecting arm 230 is movably connected to head panel frame 310 at a more proximal section 330*c* of head panel anchor plate 330 (better visualized in FIG. 4C). The rear/bottom sections of both forward and rear swinging members 315 and 320 are movably connected to a more distal section of bed deployment assembly support member 240. All four of forward swinging member 315, rear swinging member 320, distal section of bed deployment assembly support member 240, and anchor plate 330 from sections 330*a* to 330*b* form a 4-bar system at the rear end of the deployment assembly (better visualized in FIG. 4C) that deploys or retracts the head panel 300.

Figure 3:
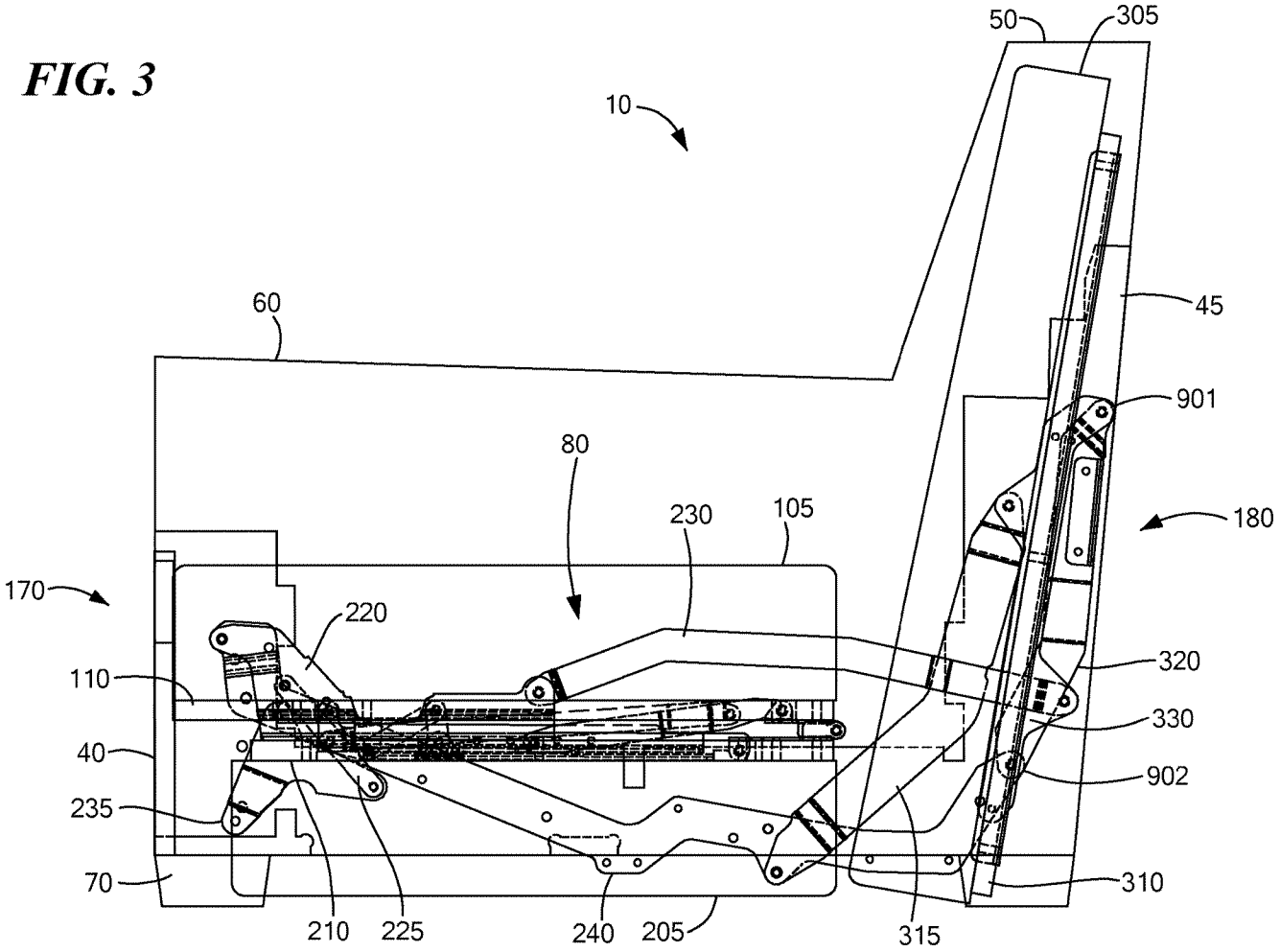
FIG. 3 is a depiction of a lateral view of an embodiment of the sofa bed without cushions with the bed assembly within the sofa in a fully folded position showing the bed deployment assemblies.
Figure 4A:
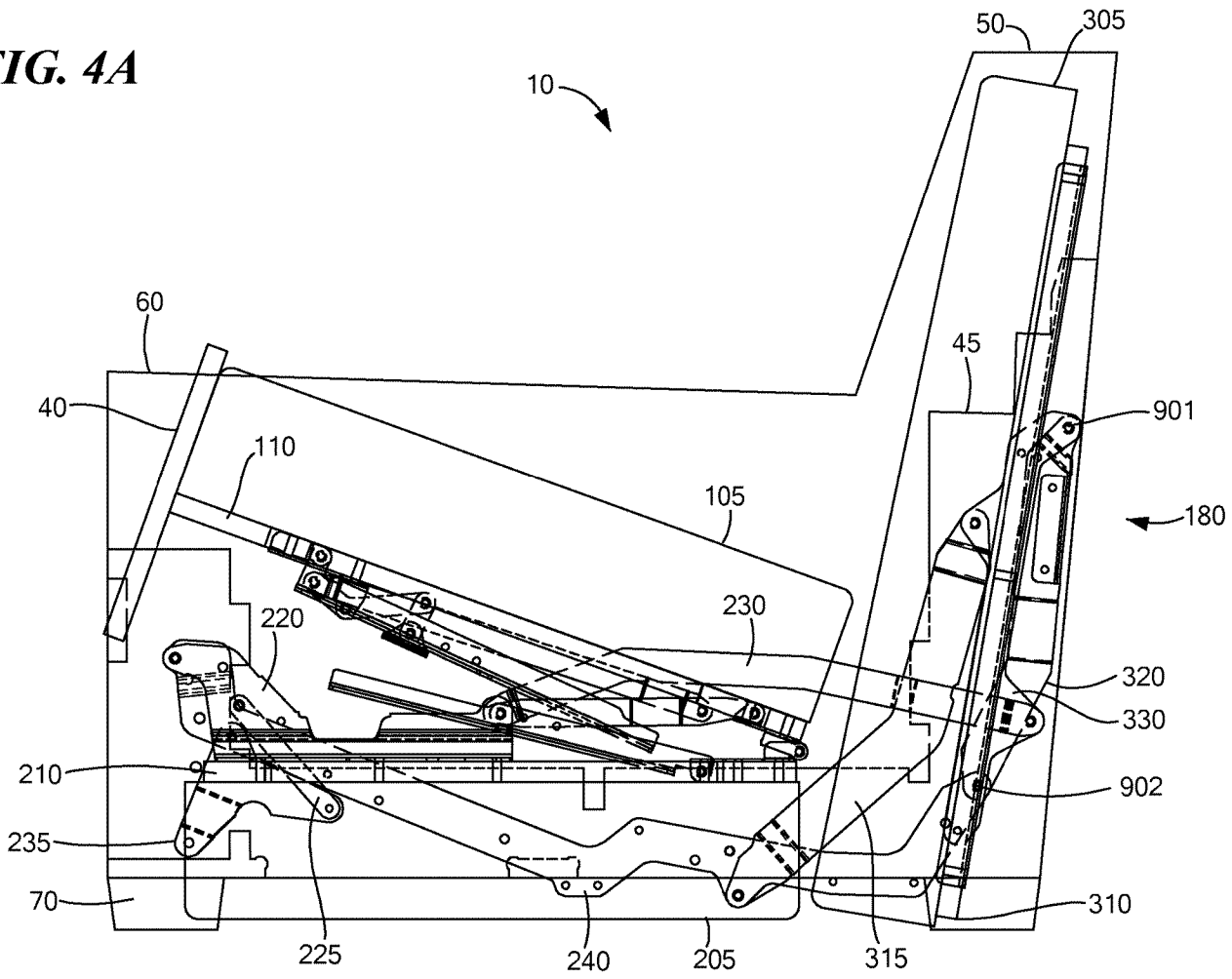
FIGS. 4A-E are depictions of a lateral view of an embodiment of the sofa bed with the bed assembly within the sofa illustrating the motions of the moving parts of the deployment assemblies as the bed is being deployed out of the sofa from a near folded position (4A) to a fully deployed position (4E).
Figure 4B:
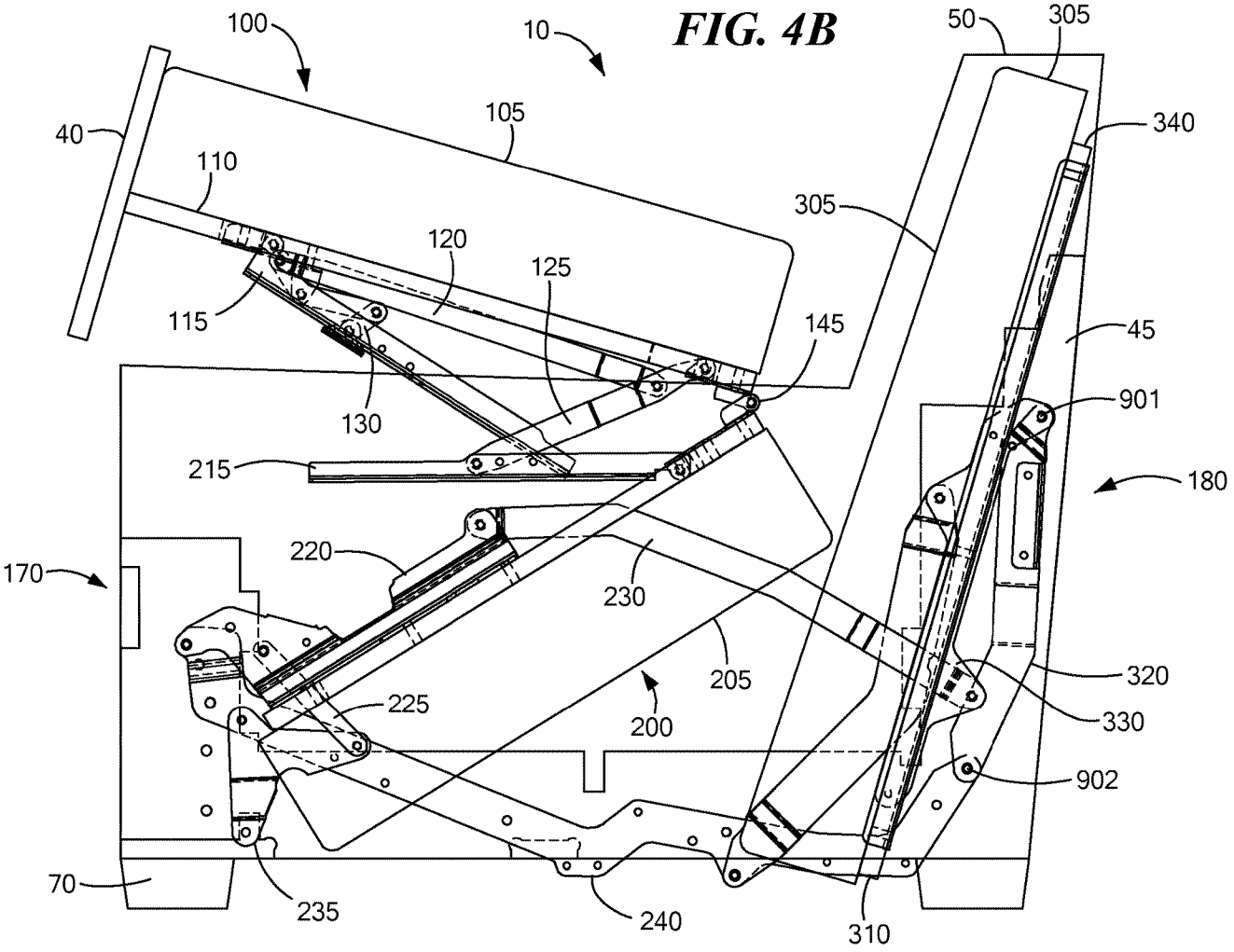

Referring to FIGS. 4A to 4E, the sofa bed 10 is transformed from a sofa configuration as seen in FIGS. 1 and 3 when the bed assembly is fully folded and contained within the outer arm panel 50, beneath the seat cushions 30, to a bed configuration when the bed is fully unfolded, lifted out of the outer arm panel 50 in a conventional manner. This maneuver can be done with or without the assistance of springs. First, the sofa seat and back cushions 20 and 30 are removed (if the sofa also contains side cushions not shown in this embodiment, those are also removed). As seen in FIG. 4A, the bed foot panel 100 is then lifted in an upward motion while applying a pull motion away from the backrest of the sofa by a human facing the forward side 170 of the sofa. As seen in FIG. 4B, as the upward pull motion is maintained, the bed unfolds such that the foot panel frame 110 separates from the middle panel frame 210 at the front side 170 of the sofa bed 10, while the back side of the foot and middle panel frames 110 and 210 pivot at the hinge 145 around pivot point 913 (shown in FIG. 5 with the other pivot points). Because hinge 145 connects the rear side of the foot panel frame 110 to the front side of the middle panel frame 210, the front side of the middle panel frame 210 is lifted first, while the back of the middle panel frame 210 rotates about pivot point 907 (shown in FIG. 5).

Figure 4C:
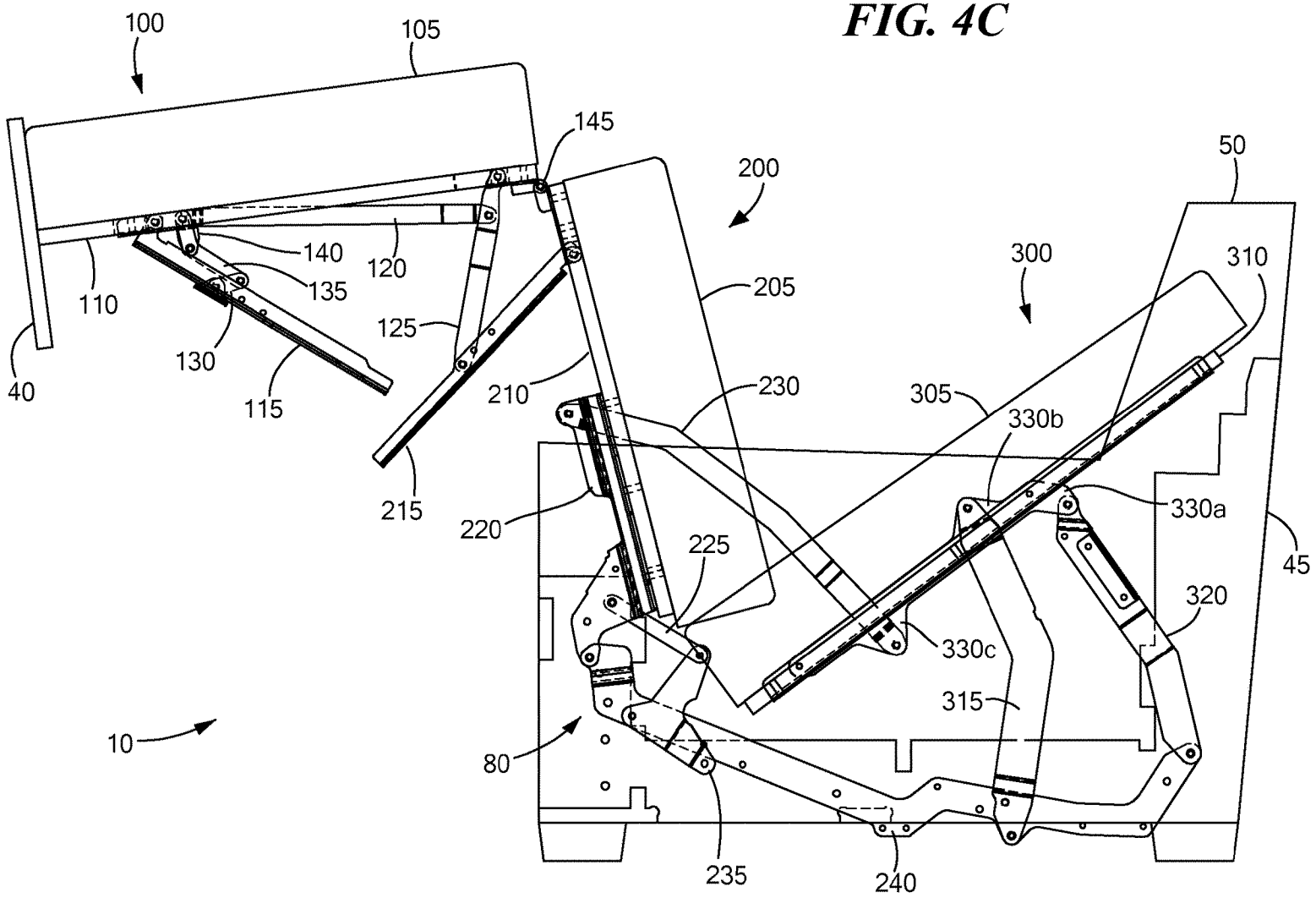
Figure 4D:
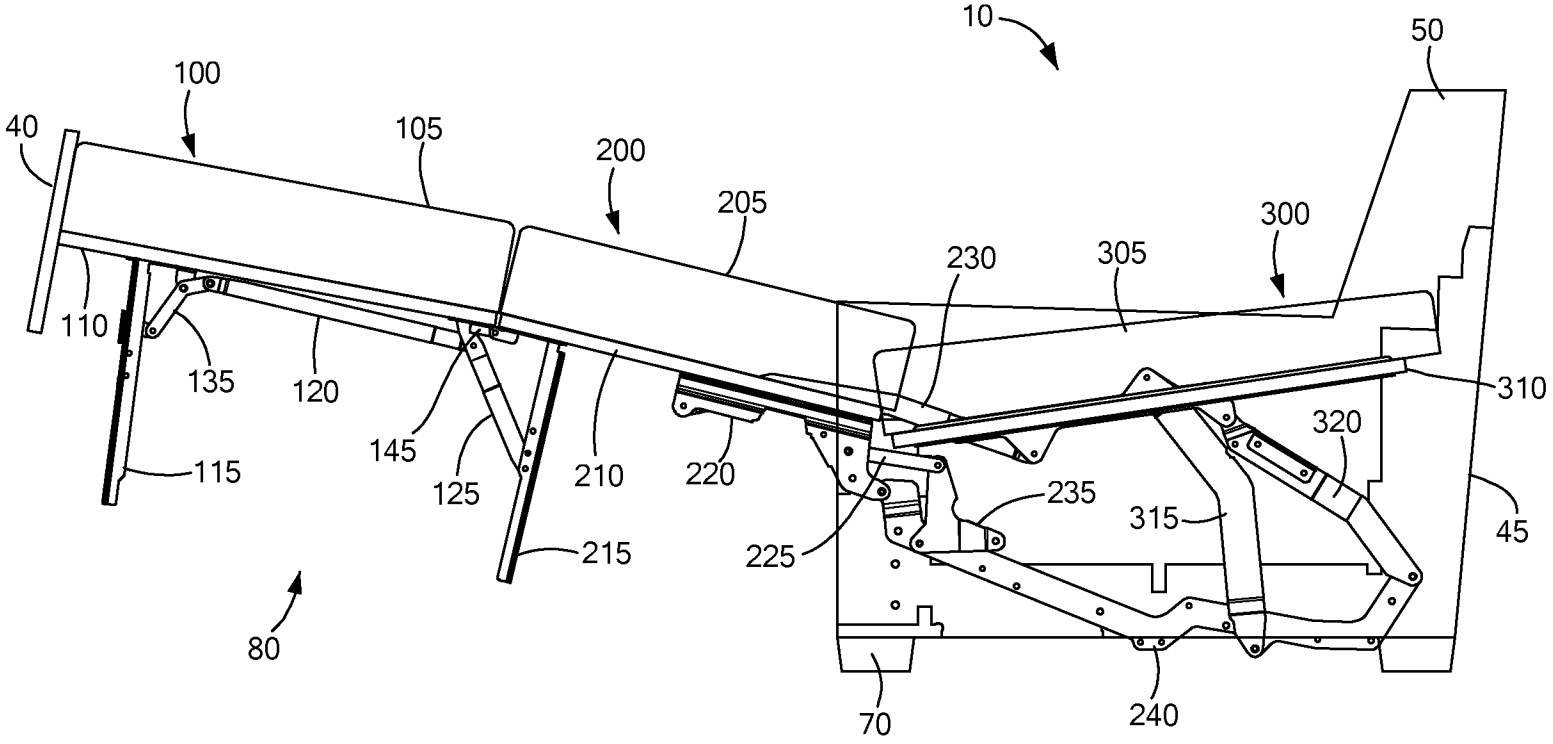

As seen in FIG. 4C, continuing to pull on the foot end bed frame 40, the foot panel 100 continues to be displaced away and upward from the outer arm panel 50. The middle panel 200 is moved from its horizontal position, seen in FIG. 1 in the fully folded configuration, to an upright configuration with the middle panel mattress 205 facing the backrest of the sofa. As distal end of middle panel anchor plate 220 rotates around pivot point 907 (shown in FIG. 5), pivot point 908 is displaced up and forward toward the front 170 of the sofa bed 10, shifting with it pivot arm and pivot point 909. Rotating plate 235 pivots around pivot point 910 displacing pivot point 911 upward.

As the middle panel 200 is moved from its horizontal position, seen in FIG. 1 in the fully folded configuration, to an upright configuration, seen in FIG. 4C in the partially unfolded configuration, the middle-to-head connecting arm 230 rotates about its mid-section, and pivot points 905 and 906 from an horizontal position to a NW-SE position, such that its proximal end is lifted upward and shifted forward toward the front end 170 of the sofa bed 10 while its distal end is shifted forward also. Because distal end of middle-to-head connecting arm 230 is movably secured to head panel anchor plate 330 at 330*c*, the bottom section of the head panel 300 is also shifted forward.

Figure 4E:
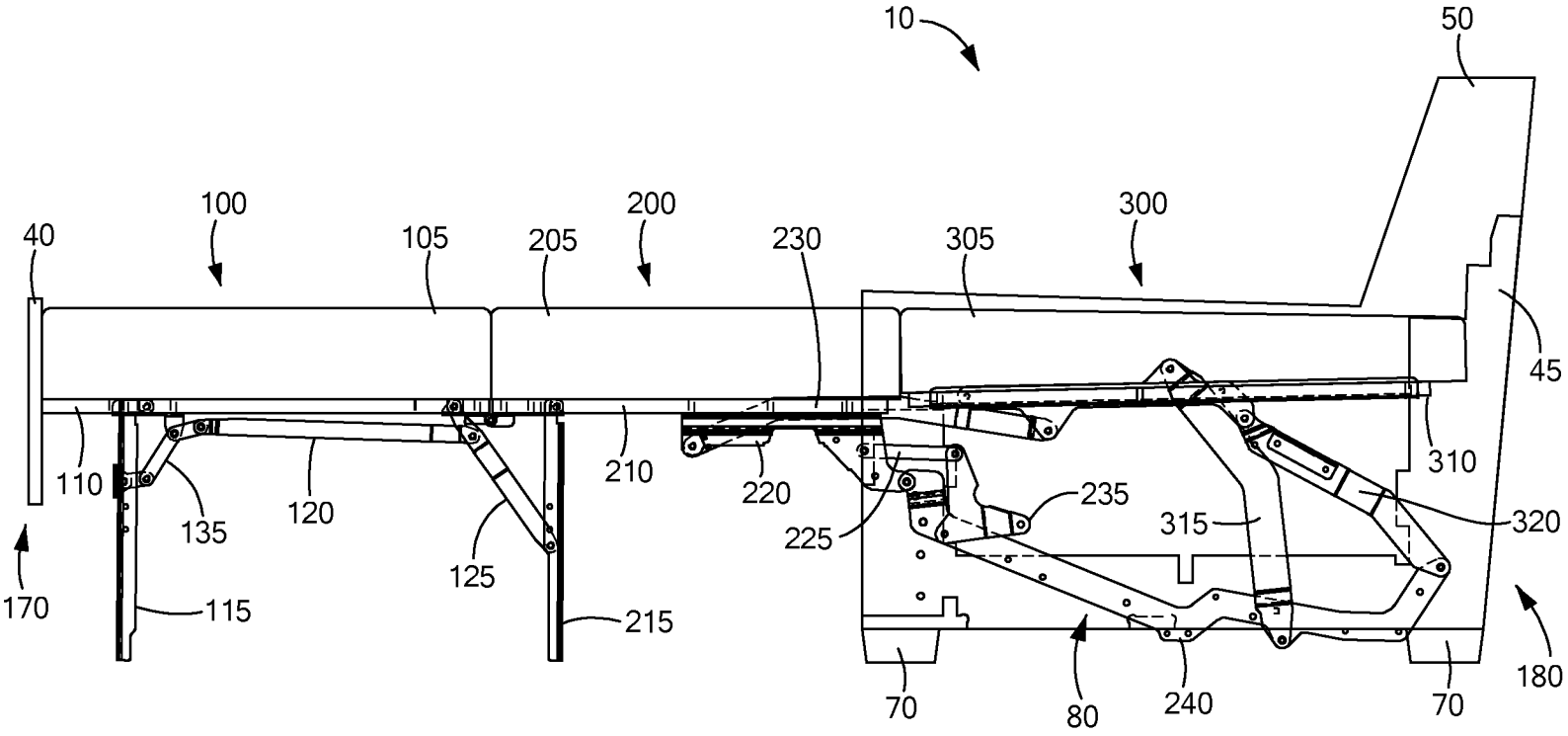
Figure 5:
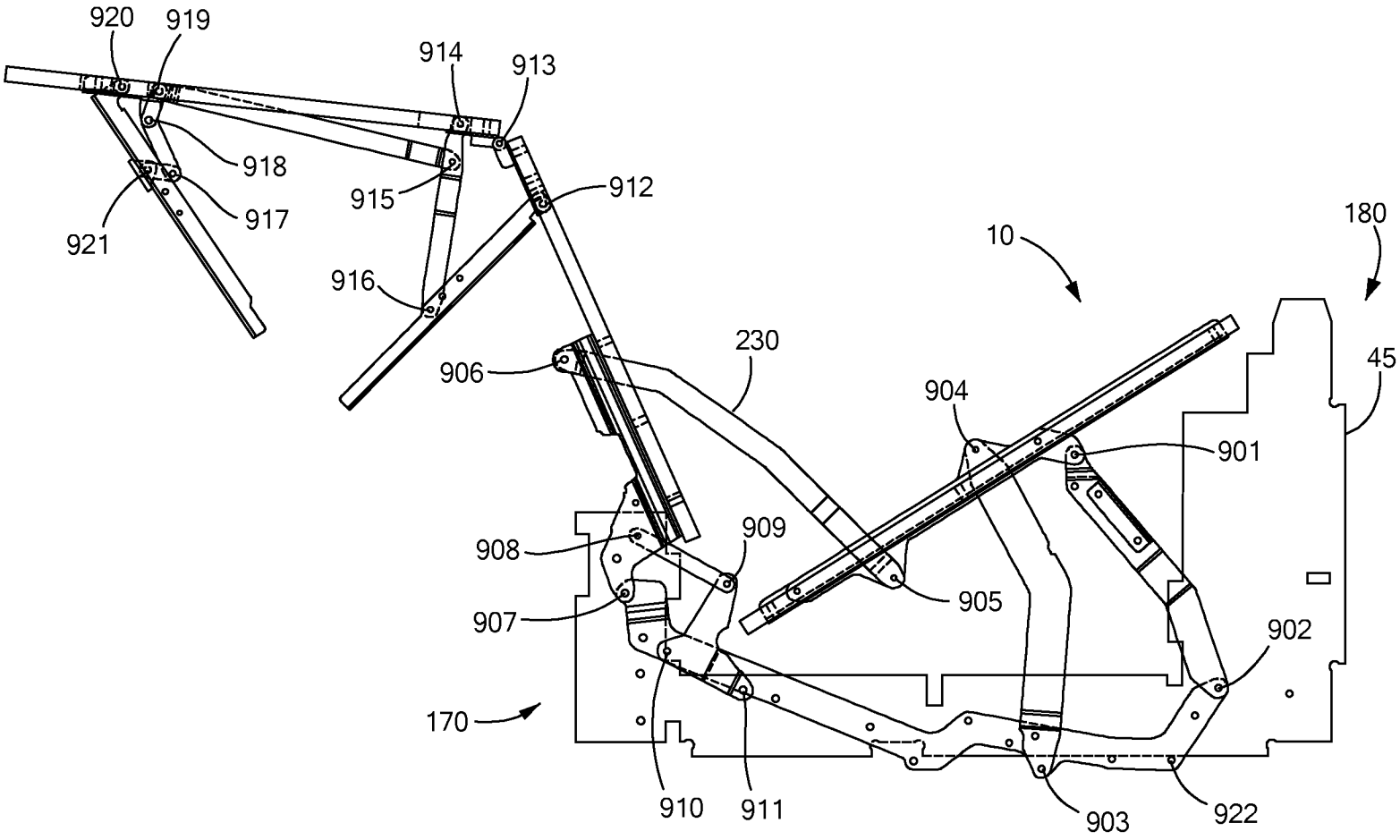
FIG. 5 is a depiction of a lateral view of an embodiment of the bed assembly without the mattresses and without the outer arm panels, with the bed assembly in a partially deployed position illustrating the various pivot points and anchor points.

Referring to FIG. 5 in addition to the earlier figures, the bed middle panel 200 rotates about pivot point 907 to flip 180° from an upside down configuration to an upside up configuration as seen in FIGS. 1 and 4E, respectively. The head panel 300 rotates about a focal point between pivot point 904 and 901 to flip from an upright configuration to a substantially horizontal configuration as seen in FIGS. 1 and 4E, respectively. This motion is enabled by the coordinated movements of middle-to-head connecting arm 230 applying a pull force, head panel forward swinging member 315, and head panel rear swinging member 320 of the rear 4-bar applying the torque force.

Head panel forward swinging member 315 is movably secured at its upward end to head panel anchor plate 330 at section 330*b* at pivot point 904, and at its downward end to deployment assembly support member 240 at a mid mounting point with pivot point 903. Head panel rear swinging member 320 is movably secured at its upward end to head panel anchor plate 330 at section 330*a* at pivot point 901, and at its downward end to deployment assembly support member 240 at a rearmost mounting point with pivot point 902. Head panel forward swinging member 315 and head panel rear swinging member 320 rotate forward about their mid and rearmost mounting pivot points 903 and 902 respectively and assist the downward and forward motions of head panel 300 as it is being deployed. They also act as supporting legs of the head panel 300 in the fully deployed configuration.

Continuing to refer to FIG. 5 and the earlier figures, a spring (not shown) can be attached to each side of the bed assembly to assist its unfolding. A proximal end of a spring can be connected to an anchor point, such as a hole or a pin, located on the protrusion of the rotating plate 235 and a distal end can be connected to anchor, such as a hole or a pin, located on deployment assembly support member 240 at pivot point 922.

Again referring to FIGS. 1, 4C to 4E, as the bed assembly is unfolded out of the outer arm panel 50, foot panel legs 115 and middle panel legs 215 unfold from a position that is parallel to foot panel frame 110 and contained within the space between foot panel frame 110 and middle panel frame 210, as seen in FIG. 1, to a deployed vertical position, as seen in FIG. 4E, such that they support foot panel frame 110 and middle panel frame 210, respectively. As foot panel frame 110 rotates about hinge 145, middle panel legs 215 unfold from a position that is parallel to foot panel frame 110 and middle panel frame 210 around pivot point 912. As the floor end of the legs shifts away from foot panel frame 110 and middle panel frame 210, pivot point 916 rotates in-turn connectors 125 around pivot point 914. As the connector 125 rotates, pivot point 915 is pulled away from foot panel frame 110, pulling with it connector 120. In a cascading sequence of motion, connector 120 rotates around pivot point 919 and pulls backward on pivot points 919 where connector 135 is movably connected. Connector 135 rotates around pivot point 918 pushing pivot point 917 towards the front foot end bed frame 40 deploying foot panel legs 115 and connector 130. Foot panel legs 115 rotate about pivot points 920 while pivot point 130 rotates about pivot point 921.

Figure 9:
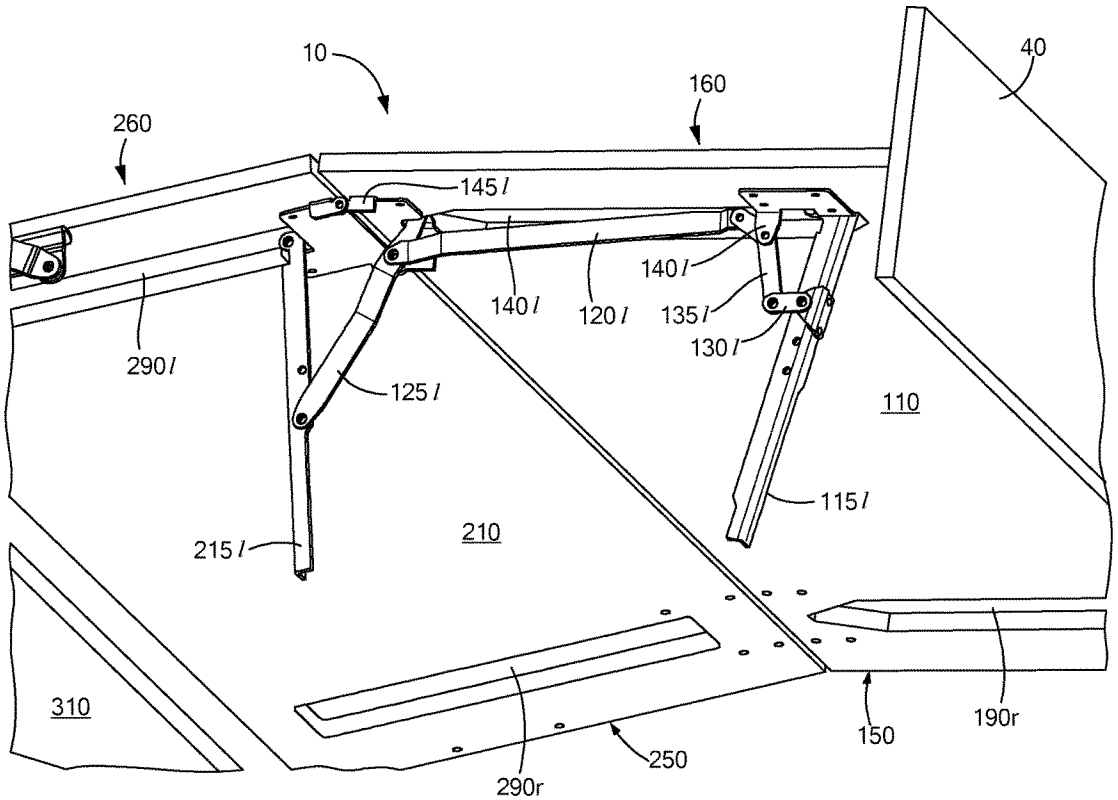
FIG. 9 is a depiction of a partial, perspective view of the front end of an embodiment of the left leg assembly from the left front corner looking upward from under the bed.
Figure 10:
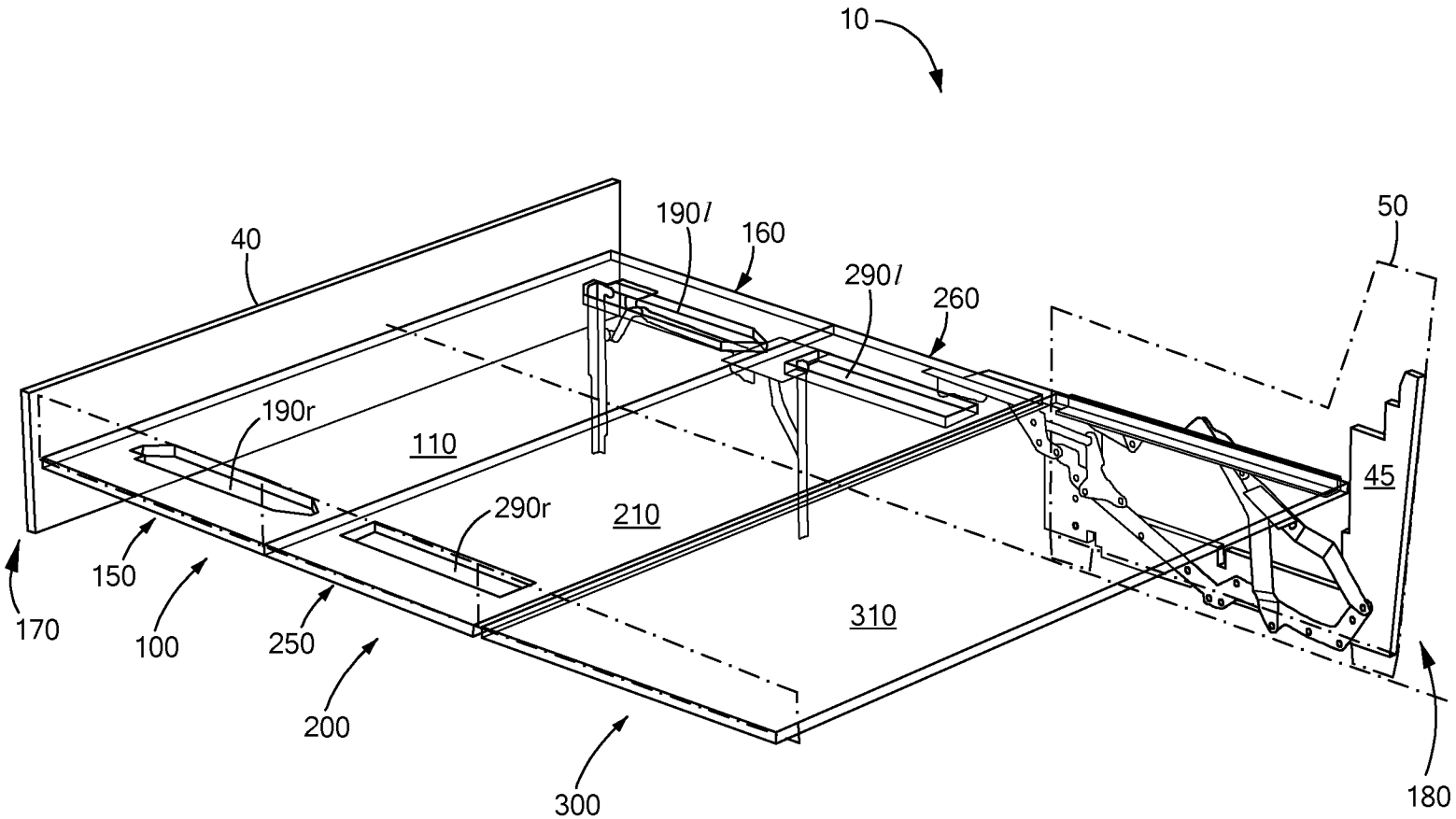
FIG. 10 is a depiction of a perspective view of an embodiment of the bed from the right rear corner looking downward from above the bed.

Referring to FIGS. 5, 9 and 10, pivots points 912, 914, 919, and 920 are positioned within the thickness of the foot and middle panel frames 110 and 210 within slots 190*l* and *r* and 290*l* and *r*, respectively. Foot panel legs 115*l* and *r* and connector 120*l* and *r* folding into the slot 190*l* and *r*, respectively, while middle panel leg 215*l* and *r* folds into slot 290*l* and *r*, respectively. This arrangement of the legs and leg assembly permits the stacking of the foot and middle panel frames 110 and 210 at a short distance of one another leaving a narrow gap of about ¾ in. wide when the bed is in a folded configuration.

Figure 6:
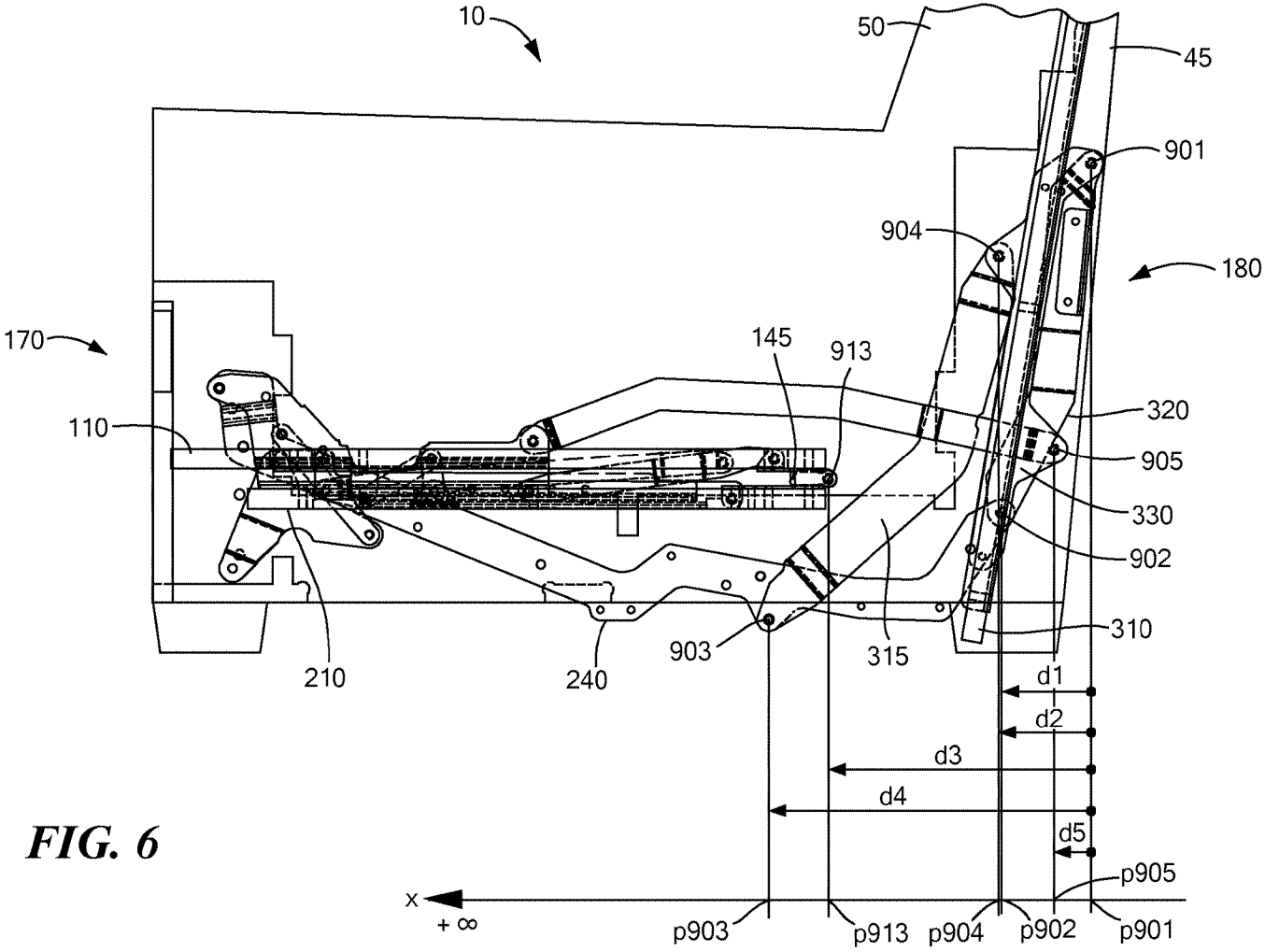
FIG. 6 is a depiction of a lateral view of an embodiment of the sofa bed with the bed assembly folded illustrating the positions of several pivot points of the deployment assembly relative to each other.

Referring to FIG. 6, the positions of the pivot points 901, 902, 903, 904 and 913 of the 4-bar positioned at the rear of the deployment assembly and the hinge 145 connecting middle panel frame 210 with foot panel frame 110, when the bed is in the folded configuration are advantageously situated to create a compact sofa as viewed from the side. This has been made possible by positioning pivot point 902 near the vertical below pivot point 904, and pivot point 903 below and further forward toward the front of the sofa respective to pivot point 913. In FIG. 6, these positions can be seen and measured along an axis x perpendicular to the vertical projections of pivot points 901, 902, 903, 904, 905 and 913, labeled respectively P901, P902, P903, P904, P905, and P913, with 0 being the vertical projection P901 of pivot point 901, the positive numbers extending toward the front of the sofa and the negative numbers extending toward the back of the sofa. The various projections are thus positioned along axis x at various lengths identified as follows: d1 is the distance between projections P901 and P902; d2 is the distance between projections P901 and P904; d3 is the distance between projections P901 and P913; d4 is the distance between projections P901 and P903; and d5 is the distance between projection P905 and P901. Distance d1 is about equal to d2 such that the ratio of d1 over d2 about 1±0.2, such as 0.80, 0.85, 0.90, 0.95, 1.00, 1.05, 1.10, 1.15, and 1.20. Distance d3 is less or about equal to d4 such that the ratio of d3 over d4 is within the range of about 0.70 to about 1.20, such as 0.70, 0.75, 0.80, 0.85, 0.90, 0.95, 1.00, 1.05, 1.10, 1.15, and 1.20, preferably about 0.8±0.05. Distance d5 is less or equal to d2 such that the ratio of d5 over d2 is within the range of about 0.35 to about 1.00, such as 0.35, 0.40, 0.45, 0.50, 0.55, 0.60, 0.65, 0.70, 0.75, 0.80, 0.85, 0.90, 0.95, 1.00 preferably about 0.38±0.05.

Referring to FIG. 7A-E, when the bed assembly is in a fully folded position, the head panel frame 310 forms an angle θ1 with the vertical with apex A of about 10°±0.5°, in the range of 5° to 15° (±0.5°), such as one of 5°, 6°, 7°, 8°, 9°, 10°, 11°, 12°, 13°, 14°, and 15° (±0.5°). The back of outer arm panel 50 forms an angle θ2 with the vertical with apex at B of about 4°±0.5°, in the range of 3° to 10° (±0.5°) such as one of 3°, 4°, 5°, 6°, 7°, 8°, 9°, and 10° (±0.5°). Forward and rear swinging members 315 and 320 are substantially upward at an angle θ3 with apex C which is about 9°±0.5°, in the range of 4° to 14° (±0.5°), such as one of 4°, 5°, 6°, 7°, 8°, 9°, 10°, 11°, 12°, 13°, and 14° (±0.5°). The angle θ4 between proximal end of rear swinging member 320 and distal end of deployment assembly support member 240 with apex D is about 180°±2.5°, in the range of 160° to 200° (±2.5°), such as about 160°, 165°, 170°, 175°, 180°, 185°, 190°, 195°, or 200° (±2.5°). The distal and proximal ends of head panel rear swinging member 320 forms an angle θ5 with apex E of about 25°±2.5°, in the range of about 0° to about 60° (±2.5°), such as about, 0, 5, 10, 15, 20, 25, 30, 35, 40, 45, 50, 55, or 60 degrees (±2.5°). Angle θ6 formed by a median line joining the elbow $\delta^1$ of the head panel rear swinging member 320 and the elbow δ2 of the deployment assembly support member 240 and the vertical with apex F is about 30°±2.5°, in the range of about 3° to 90°, such as 3, 6, 9, 12, 15, 20, 25, 30, 35, 40, 45, 50, 55, 60, 65, 70, 75, 80, 85, or 90 degrees (±2.5°). Angle θ7 formed by the median line of distal end of head panel rear swinging member 320 and the vertical with apex G is about 5°±1°, in the range of about 3° to 20° (±1°), such as about 3, 4, 5, 6, 8, 10, 12, 14, 16, 18, or 20 degrees (±1°).

Angle θ3 allows for a compact and aesthetically pleasing design of a sofa bed according to the invention such that the back of outer arm panel 50 can be shifted toward the foot end bed frame 40, and at the base the sofa has a foot print which is more in line with non-convertible sofas with a depth front to back of about 34±0.5 in, in the range of about 25 in to less than about 40 in (±0.5 in), such as 25, 26, 27, 28, 29, 30, 31, 32, 33, 34, 35, 36, 37, 38, or 39 in (±0.5 in). In other terms, angle θ3 is such that head panel rear swinging member 320 in the fully folded bed configuration has a curvature or a bend with a focal point located toward the front 170 of the sofa bed 10. In turn, the distal end of the head panel rear swinging member 320 is substantially parallel to the head panel frame 310 and the outer arm panel 50 with angles θ1, θ2, and θ7 in a close range of each other, giving a more desirable esthetic to the convertible sofa according to the invention which is similar to conventional non-convertible sofas.

Figure 7A:
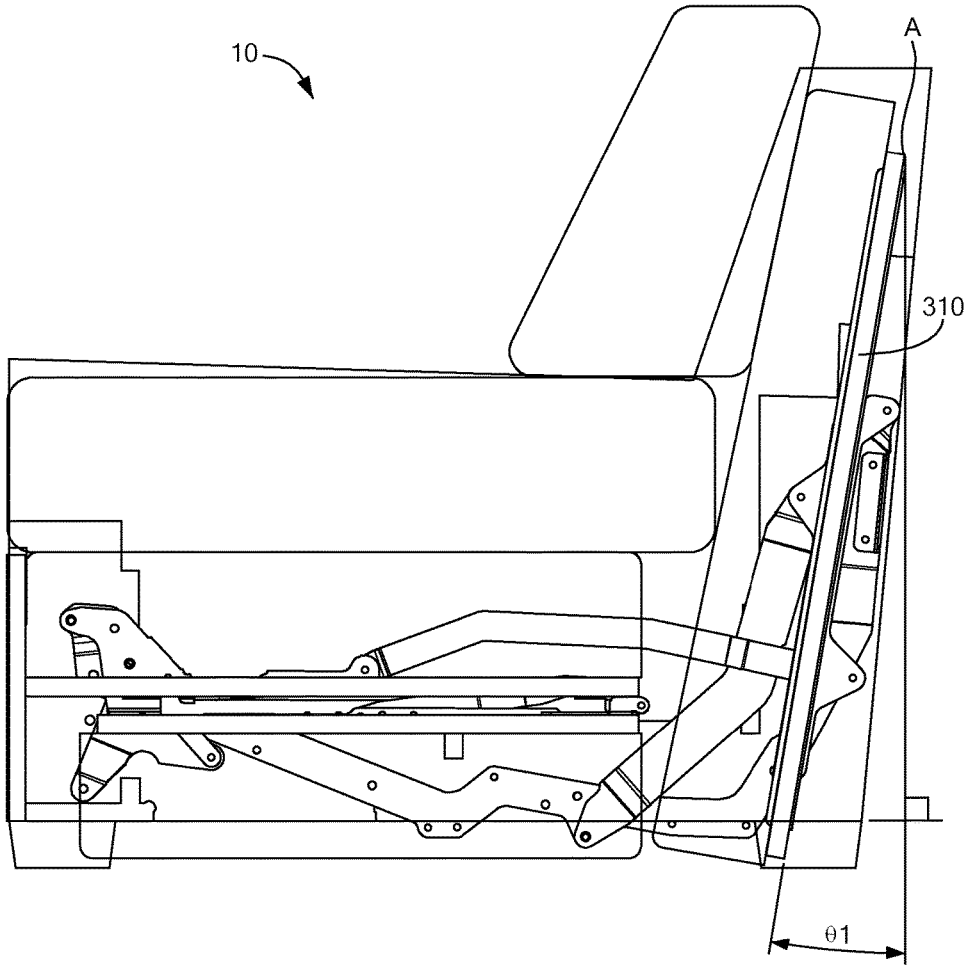
FIGS. 7A-E are depictions of a lateral view of an embodiment of the sofa bed with the bed assembly within the sofa in a fully folded position illustrating various angles of the bed head panel and the deployment assembly's forward and rear swinging members and their pivot points.
Figure 7B:
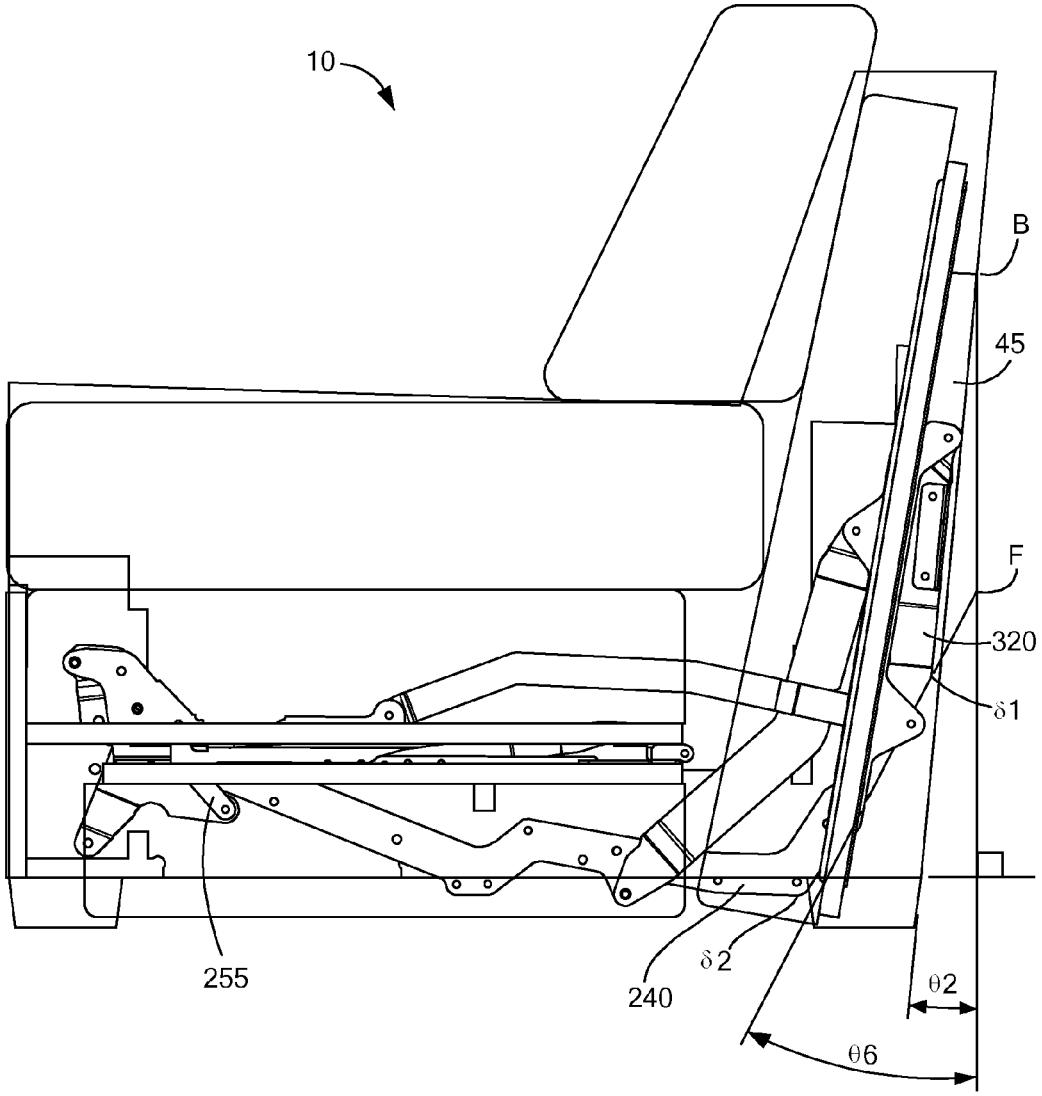
Figure 7C:
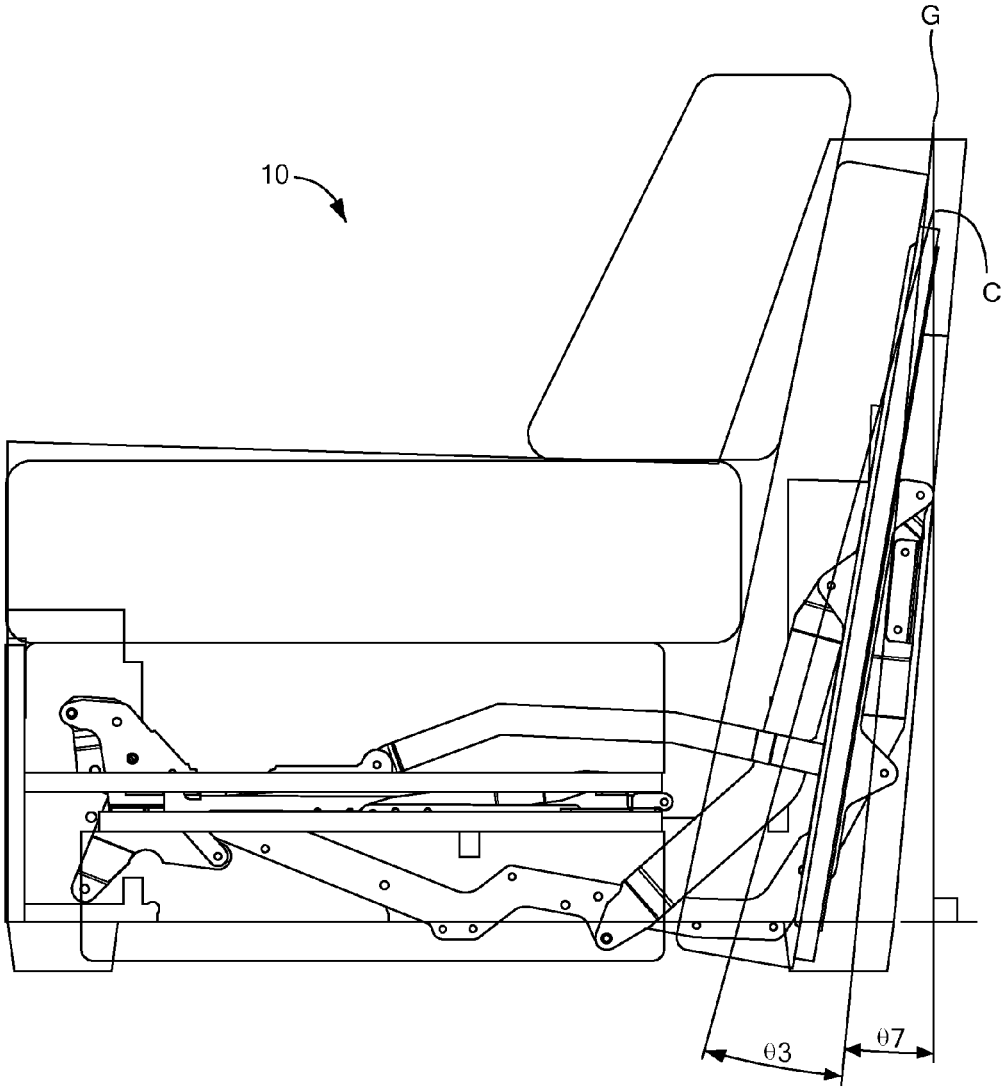
Figure 7D:
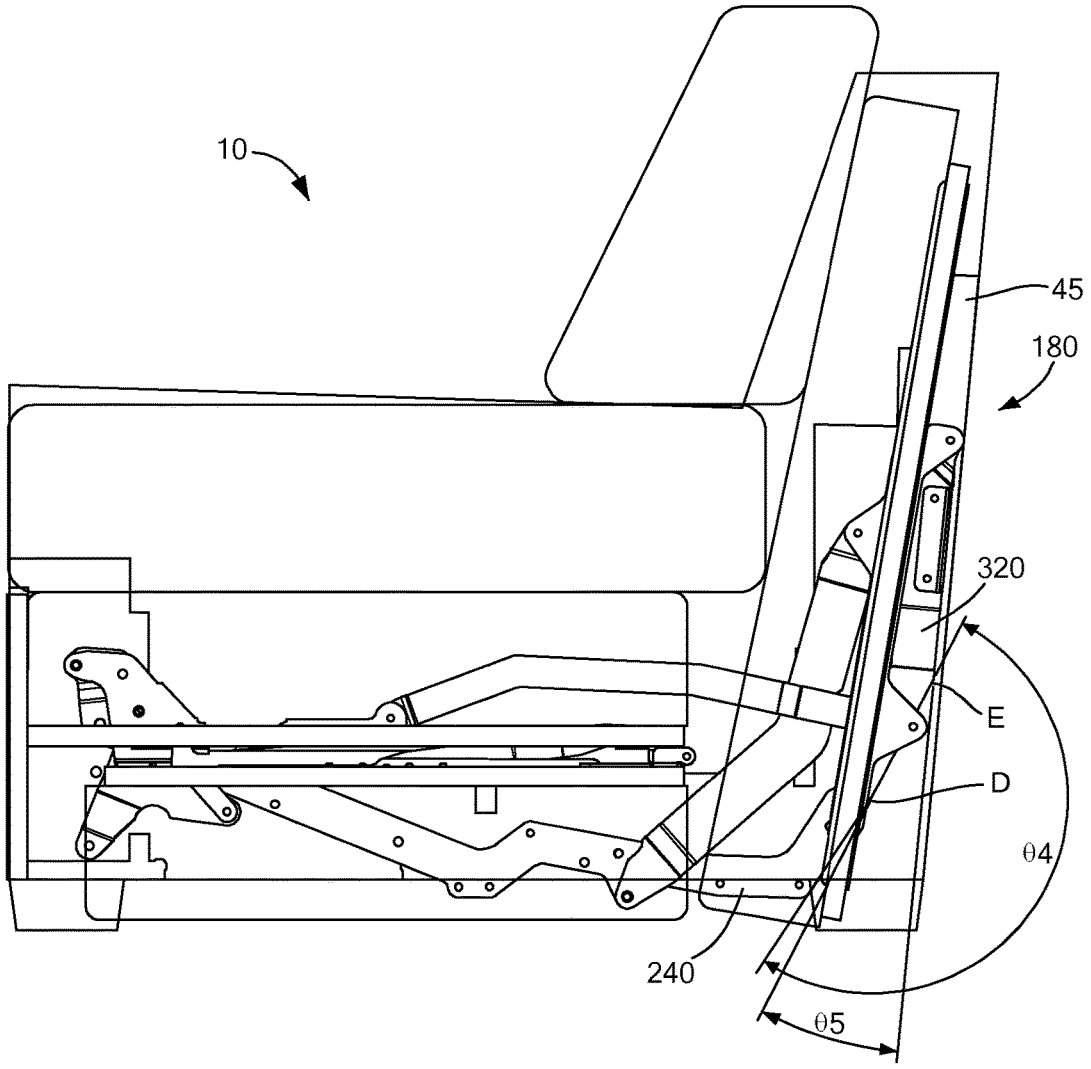
Figure 7E:
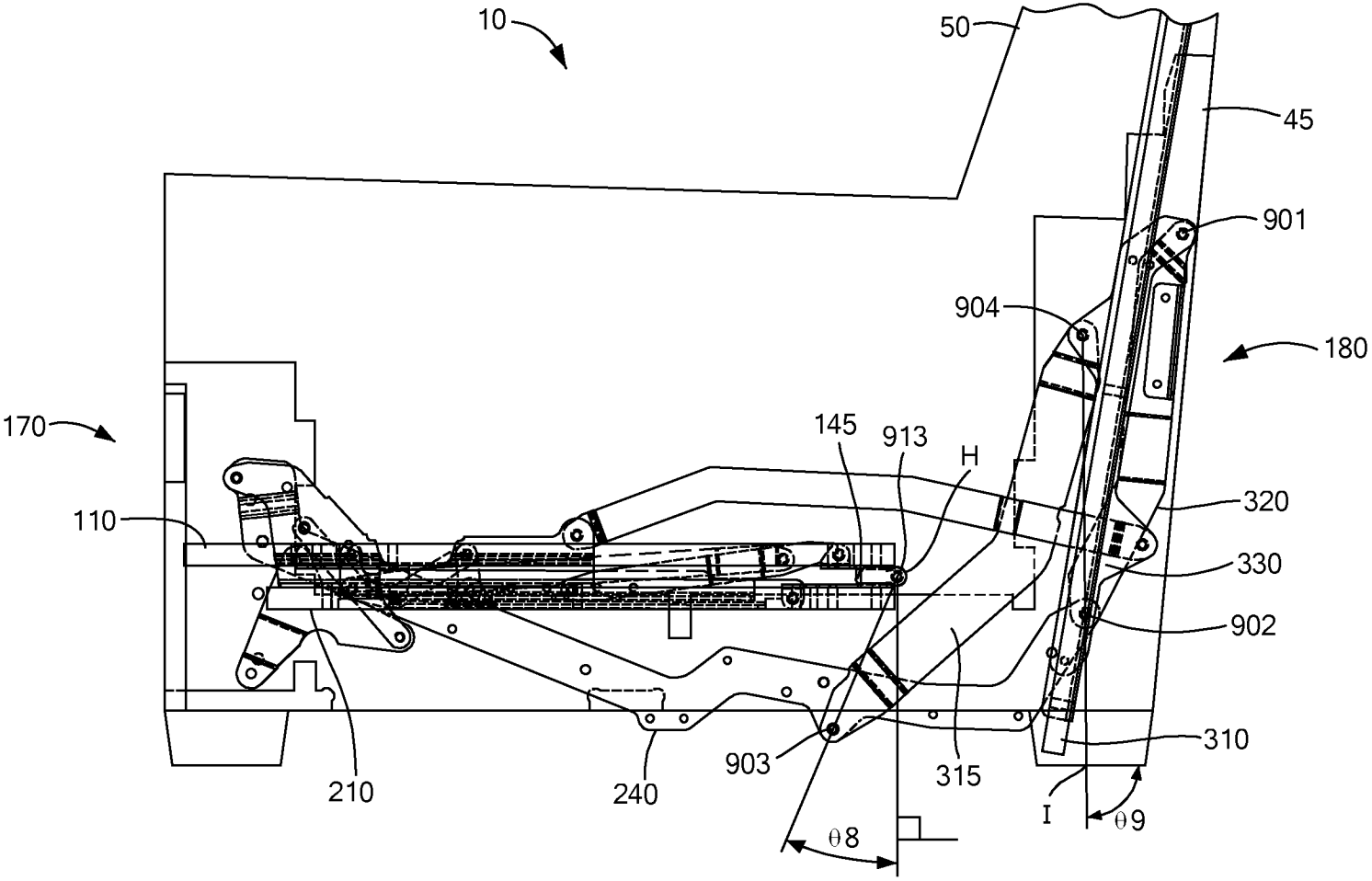

Referring to FIG. 7E, the positions of the pivot points 901, 902, 903, 904 and 913 of the 4-bar positioned at the rear of the deployment assembly and the hinge connecting middle panel frame 210 with foot panel frame 110, when the bed is in the folded configuration are advantageously situated to create a compact sofa as viewed from the side. This has been made possible by positioning pivot point 902 near the vertical below pivot point 904, and pivot point 903 further forward toward the front of the sofa respective to pivot point 913. In FIG. 7E, these positions can be seen and measured by angles θ9 and θ8 respectively, where θ8 is the angle formed by the line intersecting pivot points 903 and 913 with the vertical projection of pivot point 913 with apex H at pivot point 913, which is about 25°±10°, in the range of about 15° to 35° (±0.5°), such as one of 15°, 16°, 17°, 18°, 19°, 20°, 21°, 22°, 23°, 24°, 25°, 26°, 27°, 28°, 29°, 30°, 31°, 32°, 33°, 34°, and 35° (±0.5°); and θ9 is the angle formed by the line intersecting pivot points 902 and 904 with the horizontal of pivot point 904 with apex I, which is about 90°±5° toward the back or the front of the vertical, and in the range of about 85° to +95° (±0.5°), such as one of 85°, 86°, 87°, 88°, 89°, 90°, 91°, 92°, 93°, 94°, and 95° (±0.5°).

Figure 8A:
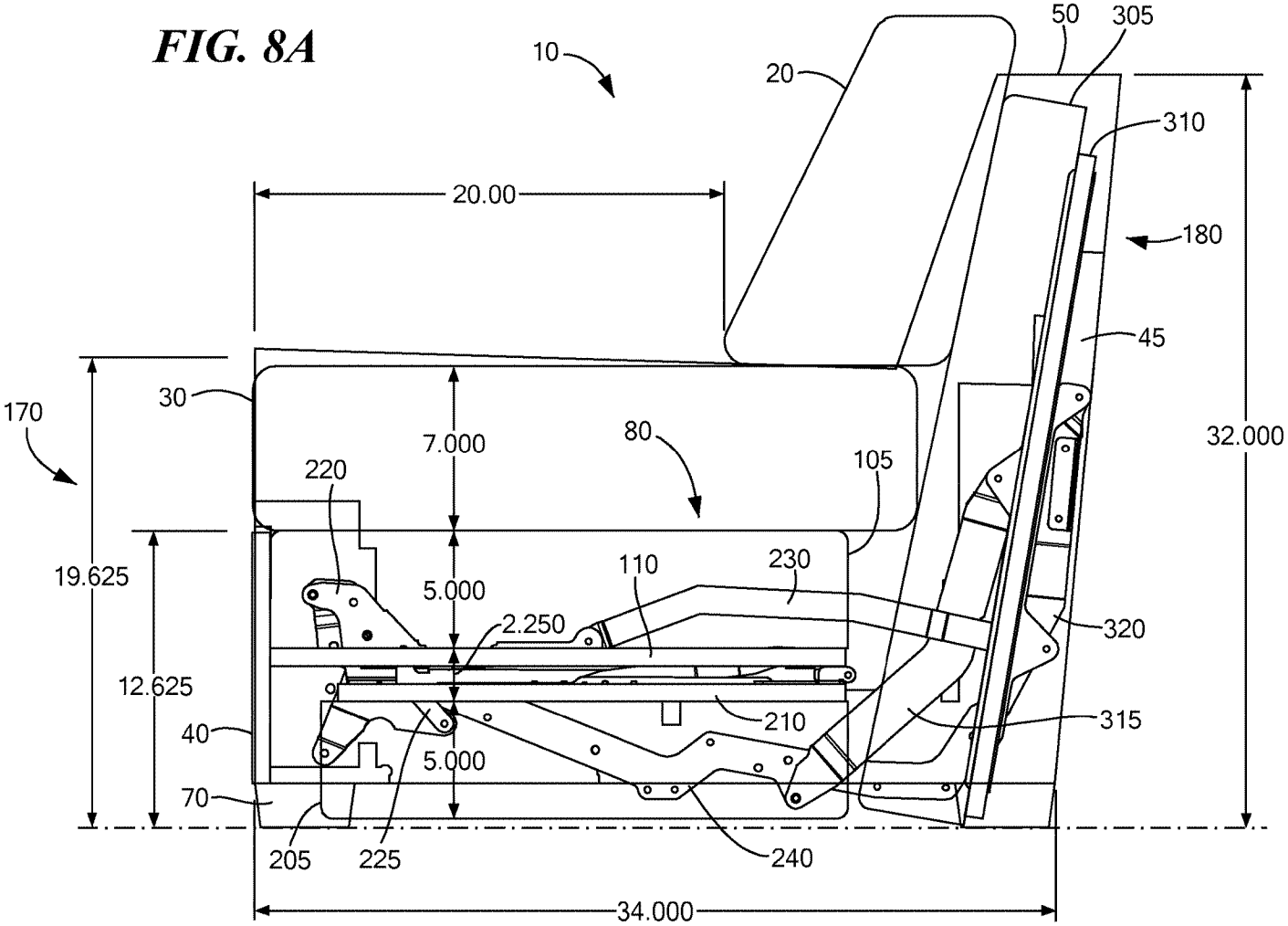
FIG. 8A is a depiction of a lateral view of an embodiment of the sofa bed with the bed assembly within the sofa in a fully folded position showing relative dimensions with the sofa cushions on, and FIG. 8B is a depiction of a lateral view of an embodiment of the articulated bed within the sofa in a fully folded position showing relative dimensions with the sofa cushions removed.
Figure 8B:
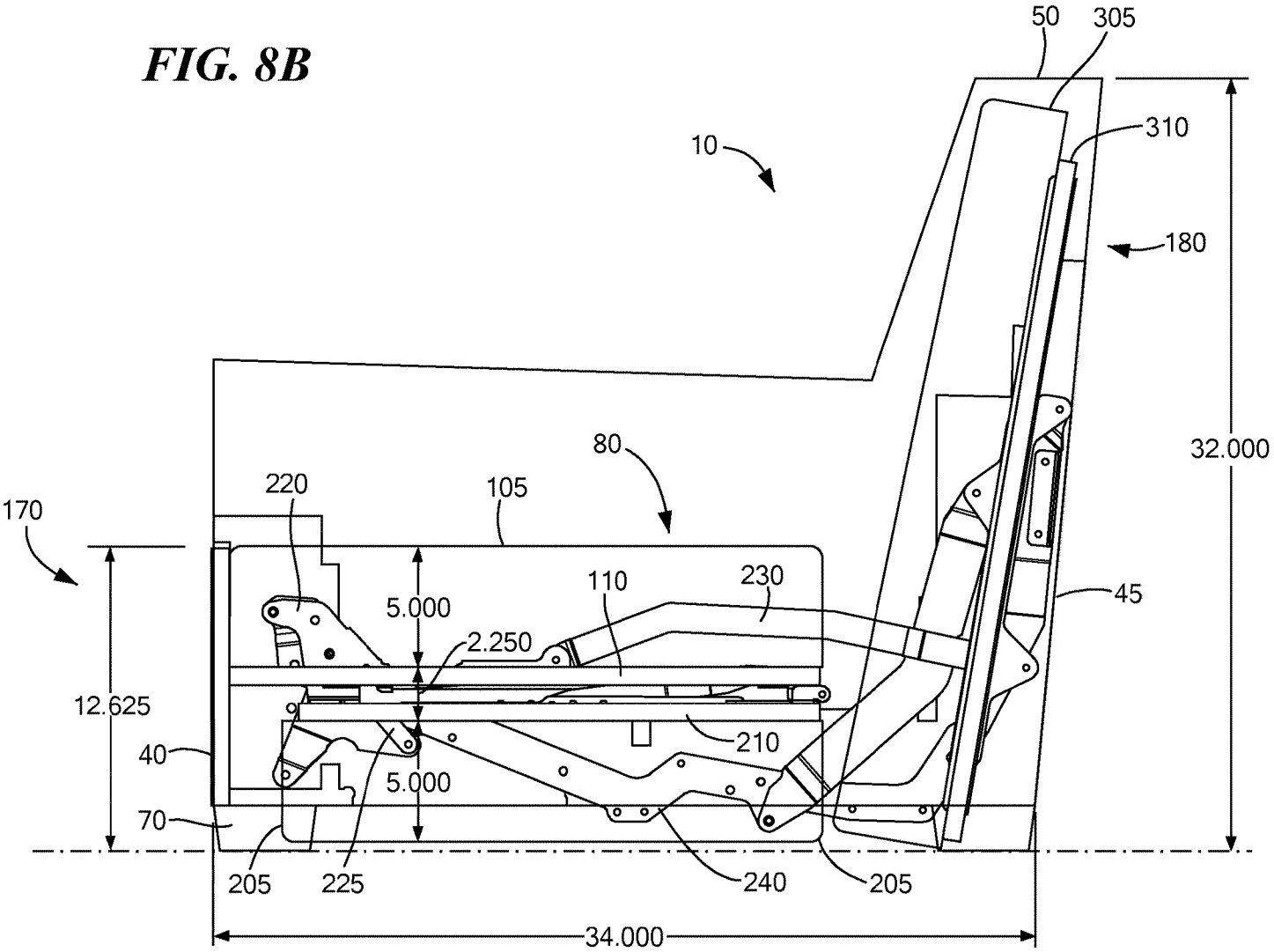

Referring to FIGS. 8A and 8B, another remarkable feature of a sofa bed according to the invention is the height location of the middle panel mattress 205 above the floor when the bed is in a folded configuration, which is about 0 in to 1.5±0.05 in, such as about 0, 0.1, 0.2, 0.3, 0.4, 0.5, 0.6, 0.7, 0.8, 0.9, 1.0, 1.1, 1.2, 1.3, 1.4 or 1.5 in (±0.05 in). This contributes the lower the height of bed foot panel 100 and the bed middle panel 200 such that the height of the top surface of foot panel mattress 105 is at about 12.6 in ±0.25 in above the floor, in the range of about 9 to 15 in (±0.25 in) such as about 9, 9.5, 10, 10.5, 11, 11.5, 12, 12.5, 13, 13.5, 14, 14.5, or 15 in (±0.25 in) while maintaining the thickness of the foot panel mattress 105 and the middle panel mattress 205 in a comfortable range of 4 to 6 in (±0.125 in), such as about 4.0, 4.25, 4.5, 4.75, 5.0, 5.25, 5.5, 5.75, 6.0 in (±0.125 in).

As seen in FIG. 8A, the total lowering of the top surface of the foot panel mattress 105 when the bed is in a folded configuration, when the two features described above are combined, contributes to lower the overall height of the seat cushion 30, such that the overall height of the top surface of the seat cushion 30 from the floor is within a comfortable range for a seated average human being and more comparable to a conventional sofa while also maintaining the thickness of the seat cushion 30 within a comfortable range and more comparable to a conventional sofa. The overall height is about 19.5±0.25 in above the floor, from a range of about 16 in to 23 in (±0.25 in), such as about 16, 16.5, 17, 17.5, 18, 18.5, 19, 19.5, 20, 20.5, 21, 21.5, 22, 22.5 or 23 in (±0.25 in). The thickness of the seat cushion 30 is about 5±0.025 in, in a range of about 3 to 7 in (±0.025 in), such as 3.0, 3.25, 3.50, 3.75, 4.0, 4.25, 4.50, 4.75, 5.0, 5.25, 5.50, 5.75, 6.0, 6.25, 6.50, 6.75, 7.0 in (±0.025 in).

Referring to FIGS. 9 and 10, yet another remarkable feature of a sofa bed according to the invention is the short distance between middle panel frame 210 and foot panel frame 110 when the bed is in a folded configuration as measured between the surfaces of the middle and foot panel frames 210 and 110 facing the middle and foot panel mattresses 105 and 205. This distance is relatively small and about 2.25±0.025 in, such as from about 2.0 to 3.0 in (±0.025 in), such as about 2.0, 2.05, 2.10, 2.15, 2.20, 2.25, 2.30, 2.35, 2.40, 2.45, 2.50, 2.55, 2.60, 2.65, 2.70, 2.75, 2.80, 2.85, 2.90, 2.95, or 3.0 in (±0.025 in). This feature is achieved by positioning the pivot points 912, 914, 919, and 920 connecting the leg assembly within the thickness of the foot and middle panel frames 110 and 210, in slots 190 and 290. Also, this feature is achieved by arranging the location of the foot panel and middle panel legs 115 and 215, respectively, such that they tuck within one another or beside each other in the folded bed configuration. The distance between the right and left foot panel legs 115 is greater than the distance between right and left middle panel legs 215. In one embodiment, the foot panel legs 115 are positioned on the outside and middle panel legs 215 are positioned on the inside of one another such that the right middle panel leg 215*r* (not shown) tucks in the right foot panel leg 115*r* (not shown) and the left middle panel leg 215*l* tucks in the left foot panel leg 115*l*. Both the foot panel and middle panel legs 115 and 215 are also located inside and away from the right 150 and left 160 sides of the foot panel frame 110, and the right 250 and left 260 sides of the middle panel frame 210 respectively.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A bed assembly mechanism for use in convertible furniture, the bed assembly comprising:

a body section and a foot section, each of which is stowed within a seat in a folded position, and unfold to form at least a portion of a bed as a substantially horizontal panel in an unfolded position;

the body section comprises a body panel frame and a body section mattress, the body section having a bed side surface and a floor side surface, and a body section thickness defined as a distance between the bed side surface and the floor side surface;

the foot section comprises a foot panel frame and a foot section mattress, the foot section having a bed side surface and a floor side surface, and a foot section thickness defined as a distance between the bed side surface and floor side surface;

the body section floor side surface and foot section floor side surface facing one another when the body section and foot section are in the folded position;

the body section floor side surface supporting at least one body leg assembly that has a first stowed position when the body section is in the folded position, and a first extended position when the body section is in the unfolded position;

the foot section side surface supporting at least one foot leg assembly that has a second stowed position when the foot section is in the folded position, and a second extended position when the foot section is in the unfolded position;

wherein, the body leg assembly is pivotally attached to the body section at a body mounting point located at a position other than edges of the body section, the body mounting point positioned in the body section between the floor side surface and bed side surface thereof; and wherein, the foot leg assembly is pivotally attached to the foot section at a foot mounting point located at a position other than edges of the foot section, the foot mounting point positioned in the foot section between the floor side surface and the bed side surface thereof.

2. The bed assembly mechanism of claim 1, wherein the body leg assembly and the foot leg assembly stow and extend with the folding and unfolding of the body section and the foot section.

3. The bed assembly mechanism of claim 1, wherein:

the floor side surface of the body section includes a first pair of slots to accommodate the body mounting points and at least partially accommodate the body leg assembly in the folded position of the mechanism, and the floor side surface of the foot section includes a second pair of slots to at least partially accommodate the foot leg assembly in the folded position of the mechanism.

4. The bed assembly mechanism of claim 1, wherein the body leg assembly comprises a body leg and a first connector;

wherein the foot leg assembly comprises a foot leg and a second connector; and a third connector links the body leg assembly with the foot leg assembly.

5. The bed assembly mechanism of claim 1, wherein a space between the floor side surface of the body section and the floor side surface of the foot section in the folded position of the mechanism is about ¾ inches wide or less.

6. The bed assembly mechanism of claim 1, with respect to the folded position of the mechanism, a distance between the bed side surface of the foot section and the bed side surface of the body section is between about 2.0 and 3.0 inches.

7. The bed assembly mechanism of claim 1, further comprising a head section, in the unfolded position, the body section is positioned between the head section and the foot section.

8. The bed assembly mechanism of claim 7, wherein, in the folded position, the head section is generally upright.

9. Convertible furniture, comprising:

at least two bed deployment assemblies, the deployment assemblies collectively supporting:

a first panel, and a second panel, wherein, the panels form a substantially horizontal plane when the assemblies are in an unfolded position, each panel having a face for receiving a mattress section and a back; and, wherein the first panel and the second panel at least partially form a seat when the assemblies are in a folded position, wherein, each of the first and second panels having a thickness between the face and the back thereof, the first panel has a pair of first foldable legs that support the first panel when in the unfolded position, the second panel has a pair of second foldable legs that support the second panel when in the unfolded position, wherein, the first legs are pivotally connected to the first panel at a first mounting point located at least partially within the thickness of the first panel, wherein, the second legs are pivotally connected to the second panel at a second mounting point located at least partially within the thickness of the second panel, and wherein the first and second mounting points are not external to the first and second panels respectively.

10. The furniture of claim 9, wherein, in the folded position, the first foldable legs and the second foldable legs are parallel to the first panel and the second panel and contained within a space between the first panel and the second panel; and, in the unfolded position, the first foldable legs and the second foldable legs are perpendicular to the first panel and second panel respectively.

11. The furniture of claim 10, wherein the first legs and the second legs fold and unfold with the folding and unfolding of the first panel and the second panel.

12. The furniture of claim 10, wherein the space between the back of the first panel and the back of the second panel in the folded position is about ¾ inches wide or less.

13. The furniture of claim 9, wherein:

the first panel includes a first pair of slots to accommodate the first mounting points and at least partially accommodate the first legs in the folded position of the assembly, and the second panel includes a second pair of slots to accommodate the second mounting points and at least partially accommodate the second legs in the folded position of the assembly.

14. The furniture of claim 9, with respect to the folded position, a distance between the face of the second panel and the face of the first panel is between about 2.0 and 3.0 inches.

15. Convertible furniture, comprising:

a frame; and a bed assembly convertible between a folded position substantially within the frame and an unfolded position extending at least partially from the frame, the bed assembly comprising:

a head panel, a middle panel, and a foot panel, the panels defining a sleeping direction in the unfolded position, a pair of foldable middle legs that support the middle panel when in the unfolded position, a pair of foldable foot legs that support the foot panel when in the unfolded position, wherein, the pair of foot legs being spaced apart, in a direction perpendicular to the sleeping direction, further than the pair of middle legs.

16. The furniture of claim 15, wherein, the middle legs are pivotally connected to the middle panel at a middle mounting point, wherein, the foot legs are pivotally connected to the foot panel at a foot mounting point, and wherein the middle mounting point and the foot mounting point are not external to the middle panel and foot panel respectively.

17. The furniture of claim 16, wherein, the middle mounting point is located within a thickness of the middle panel, and wherein, the foot mounting point located within a thickness of the foot panel.

18. The furniture of claim 15, wherein, in the folded position, the middle legs and the foot legs are parallel to the foot panel and the middle panel and contained within a space between the foot panel and the middle panel, and in the unfolded position, the middle legs and the foot legs are perpendicular to the middle panel and foot panel respectively.

19. The furniture of claim 15, wherein the middle legs and the foot legs fold and unfold with the folding and unfolding of the middle panel and the foot panel.

* * * * *